US011812916B2

(12) United States Patent
Blouin

(10) Patent No.: US 11,812,916 B2
(45) **Date of Patent: *Nov. 14, 2023**

(54) VACUUM BRUSH

(71) Applicant: iRobot Corporation, Bedford, MA (US)

(72) Inventor: Matthew Blouin, Townsend, MA (US)

(73) Assignee: iRobot Corporation, Bedford, MA (US)

( * ) Notice: Subject to any disclaimer, the term of this patent is extended or adjusted under 35 U.S.C. 154(b) by 44 days.

This patent is subject to a terminal disclaimer.

(21) Appl. No.: 17/371,239

(22) Filed: Jul. 9, 2021

(65) Prior Publication Data

US 2021/0386256 A1 Dec. 16, 2021

Related U.S. Application Data

(63) Continuation of application No. 16/429,430, filed on Jun. 3, 2019, now Pat. No. 11,058,271, which is a continuation of application No. 14/325,997, filed on Jul. 8, 2014, now Pat. No. 10,314,449, which is a continuation of application No. 13/028,996, filed on Feb. 16, 2011, now Pat. No. 8,800,107.

(60) Provisional application No. 61/304,886, filed on Feb. 16, 2010.

(51) Int. Cl.
*A47L 9/04* (2006.01)

(52) U.S. Cl.
CPC ..... *A47L 9/0477* (2013.01); *A47L 9/0427* (2013.01); *A47L 9/0455* (2013.01)

(58) Field of Classification Search
CPC ..... A47L 9/0477; A47L 9/0427; A47L 9/0455
See application file for complete search history.

(56) References Cited

U.S. PATENT DOCUMENTS

| | | | | |
|---|---|---|---|---|
| 1,755,054 | A * | 4/1930 | Darst | F16C 33/805 384/488 |
| 1,999,696 | A | 4/1935 | Kitto | |
| 2,176,769 | A | 10/1939 | Martinet | |
| 3,216,047 | A | 11/1965 | Carl-oskar | |

(Continued)

FOREIGN PATENT DOCUMENTS

| | | |
|---|---|---|
| CN | 1806740 | 7/2006 |
| WO | 03071914 | 9/2003 |

(Continued)

OTHER PUBLICATIONS

"U.S. Appl. No. 13/028,996, Non Final Office Action dated Jan. 4, 2013", 8 pgs.

(Continued)

*Primary Examiner* — Andrew A Horton
(74) *Attorney, Agent, or Firm* — Schwegman Lundberg & Woessner, P.A.

(57) ABSTRACT

A rotating cleaning element configured to be inserted in a cleaning head compartment of a robotic vacuum, the rotating cleaning element including: a drive end including a drive protrusion configured to engage a drive mechanism of the cleaning head compartment; a bearing end and a shroud configured to surround at least a portion of the bearing end to lessen an amount of hair and similar matter that reaches the bearing; and a central member extending between the bearing end and the drive end.

19 Claims, 23 Drawing Sheets

(56) References Cited

U.S. PATENT DOCUMENTS

| | | | | |
|---|---|---|---|---|
| 3,639,941 | A | 2/1972 | Kirwan et al. | |
| 4,429,430 | A | 2/1984 | Yman | |
| 5,272,785 | A | 12/1993 | Stegens | |
| 5,435,038 | A | 7/1995 | Sauers | |
| 5,452,490 | A | 9/1995 | Brundula et al. | |
| 5,465,451 | A * | 11/1995 | Stegens | A46B 13/001 492/29 |
| 6,003,198 | A | 12/1999 | Stegens | |
| 6,810,559 | B2 | 11/2004 | Mertes et al. | |
| 8,800,107 | B2 | 8/2014 | Blouin | |
| 11,058,261 | B2 * | 7/2021 | Bullock | A47K 5/1217 |
| 2001/0008036 | A1 | 7/2001 | Worwag | |
| 2001/0022010 | A1 | 9/2001 | Kasper | |
| 2004/0049877 | A1 | 3/2004 | Jones et al. | |
| 2004/0078924 | A1 | 4/2004 | Roney et al. | |
| 2005/0138765 | A1 | 6/2005 | Lee | |
| 2006/0042042 | A1 | 3/2006 | Mertes et al. | |
| 2009/0169146 | A1 | 7/2009 | Gagnon | |

FOREIGN PATENT DOCUMENTS

| | | |
|---|---|---|
| WO | 2006061044 | 6/2006 |
| WO | 2008091199 | 7/2008 |

OTHER PUBLICATIONS

"U.S. Appl. No. 13/028,996, Response filed Apr. 15, 2013 to Non Final Office Action dated Jan. 4, 2013", 12 pgs.
"U.S. Appl. No. 13/028,996, Final Office Action dated May 8, 2013", 8 pgs.
"U.S. Appl. No. 13/028,996, Response filed Jun. 19, 2013 to Final Office Action dated May 8, 2013", 8 pgs.
"U.S. Appl. No. 13/028,996, Examiner Interview Summary dated Jun. 19, 2013", 3 pgs.
"U.S. Appl. No. 13/028,996, Notice of Allowance dated Jul. 17, 2013", 8 pgs.
"U.S. Appl. No. 13/028,996, Notice of Allowance dated Dec. 27, 2013", 8 pgs.
"U.S. Appl. No. 13/028,996, Notice of Allowance dated Jul. 2, 2014", 6 pgs.
"International Application Serial No. PCT US2011 025095, International Search Report dated May 30, 2011", 3 pgs.
"International Application Serial No. PCT US2011 025095, Written Opinion dated May 30, 2011", 7 pgs.
"International Application Serial No. PCT US2007 069389, International Search Report dated Feb. 14, 2008", 3 pgs.
"International Application Serial No. PCT US2007 069389, Written Opinion dated Feb. 14, 2008", 6 pgs.
"International Application Serial No. PCT US2007 069389, International Preliminary Report on Patentability dated Nov. 4, 2008", 8 pgs.
"International Application Serial No. PCT US2004 001504, Written Opinion dated Aug. 20, 2012", 9 pgs.
"U.S. Appl. No. 14/325,997, Preliminary Amendment filed Jan. 9, 2015", 6 pgs.
"U.S. Appl. No. 14/325,997, Preliminary Amendment filed Apr. 7, 2017", 6 pgs.
"U.S. Appl. No. 14/325,997, Restriction Requirement dated May 5, 2017", 7 pgs.
"U.S. Appl. No. 14/325,997, Response filed Jul. 5, 2017 to Restriction Requirement dated May 5, 2017", 5 pgs.
"U.S. Appl. No. 14/325,997, Non Final Office Action dated Aug. 2, 2017", 9 pgs.
"U.S. Appl. No. 14/325,997, Response filed Dec. 1, 2017 to Non Final Office Action dated Aug. 2, 2017", 7 pgs.
"U.S. Appl. No. 14/325,997, Final Office Action dated Dec. 15, 2017", 10 pgs.
"U.S. Appl. No. 14/325,997, Response filed Apr. 6, 2018 to Final Office Action dated Dec. 15, 2017", 10 pgs.
"U.S. Appl. No. 14/325,997, Advisory Action dated Apr. 17, 2018", 2 pgs.
"U.S. Appl. No. 14/325,997, Examiner Interview Summary dated May 1, 2018", 3 pgs.
"U.S. Appl. No. 14/325,997, Response filed May 8, 2018 to Advisory Action dated Apr. 17, 2018", 14 pgs.
"U.S. Appl. No. 14/325,997, Non Final Office Action dated Aug. 29, 2018", 12 pgs.
"U.S. Appl. No. 14/325,997, Examiner Interview Summary dated Dec. 7, 2018", 4 pgs.
"U.S. Appl. No. 14/325,997, Response filed Dec. 12, 2018 to Non Final Office Action dated Aug. 29, 2018", 11 pgs.
"U.S. Appl. No. 14/325,997, Notice of Allowance dated Jan. 25, 2019", 6 pgs.
"International Application Serial No. PCT US2011 025095, International Preliminary Report on Patentability dated Aug. 30, 2012", 9 pgs.
"European Application Serial No. 11713539.2, Response filed Mar. 25, 2013 to Communication pursuant to Rules 161(1) and 162 EPC dated Sep. 25, 2012", 10 pgs.
"European Application Serial No. 11713539.2, Communication Pursuant to Article 94(3) EPC dated Feb. 3, 2014", 4 pgs.
"European Application Serial No. 11713539.2, Response filed May 29, 2014 to Communication Pursuant to Article 94(3) EPC dated Feb. 3, 2014", 17 pgs.
"European Application Serial No. 11713539.2, Communication Pursuant to Article 94(3) EPC dated Nov. 4, 2014", 4 pgs.
"European Application Serial No. 11713539.2, Response filed Mar. 16, 2015 to Communication Pursuant to Article 94(3) EPC dated Nov. 4, 2014", 10 pgs.
"European Application Serial No. 11713539.2, Communication Pursuant to Article 94(3) EPC dated Dec. 3, 2015", 4 pgs.
"European Application Serial No. 11713539.2, Response filed May 17, 2016 to Communication Pursuant to Article 94(3) EPC dated Dec. 3, 2015", 10 pgs.
"European Application Serial No. 17157969.1, Extended European Search Report dated Sep. 19, 2017", 10 pgs.
"European Application Serial No. 17157969.1, Response filed Mar. 7, 2018 to Extended European Search Report dated Sep. 19, 2017", 11 pgs.
"European Application Serial No. 17157969.1, Partial European Search Report dated Jun. 14, 2017", 11 pgs.
"U.S. Appl. No. 16/429,430, Preliminary Amendment Filed Aug. 12, 2019", 5 pgs.
"Chinese Application Serial No. 201810153702.1, Office Action dated Mar. 2, 2020", W O English Translation, 9 pgs.
"Chinese Application Serial No. 201810153702.1, Response filed Jul. 17, 2020 to Office Action dated Mar. 2, 2020", w English claims, 16 pgs.
"Chinese Application Serial No. 201810153702.1, Office Action dated Nov. 13, 2020", w English Translation, 7 pgs.
"U.S. Appl. No. 16/429,430, Non Final Office Action dated Jan. 19, 2021", 9 pgs.
"Chinese Application Serial No. 201810153702.1, Response filed Jan. 25, 2021 to Office Action dated Nov. 13, 2020", w English Claims, 15 pgs.
"U.S. Appl. No. 16/429,430, Response filed Apr. 19, 2021 to Non Final Office Action dated Jan. 19, 2021", 11 pgs.
"U.S. Appl. No. 16/429,430, Notice of Allowance dated Jun. 1, 2021", 8 pgs.

* cited by examiner

VACUUM BRUSH

CROSS REFERENCE TO RELATED APPLICATIONS

This U.S. patent application is a continuation of U.S. patent application Ser. No. 16/249,430, filed Jun. 3, 2019, issued on Jul. 13, 2021 as U.S. Pat. No. 11,058,271, which application is a continuation of and claims priority under 35 U.S.C. § 120 from U.S. patent application Ser. No. 14/325,997, now U.S. Pat. No. 10,314,449, filed on Jul. 8, 2014, which is a continuation of and claims priority under 35 U.S.C. § 120 from U.S. patent application Ser. No. 13/028,996, now U.S. Pat. No. 8,800,107, filed on Feb. 16, 2011, which claims priority under 35 U.S.C. § 119(e) to U.S. Provisional Application No. 61/304,886, filed Feb. 16, 2010. The disclosures of these prior applications are considered part of the disclosure of this application and are hereby incorporated by reference in their entireties.

TECHNICAL FIELD

This disclosure relates to a vacuum brush for a robotic vacuum. The present teachings relate more particularly to a vacuum brush for a robotic vacuum including portions that lessen the amount of hair and similar matter that reach the bearing and drive areas of the robotic vacuum cleaning head.

BACKGROUND

Hair and other similar matter can become wrapped around the ends of robotic vacuum brushes, becoming entangled in the ends of the brushes (e.g., around bearings and drive protrusions) and/or in gearboxes that drive the brushes to rotate relative to the cleanings head compartment. Such entanglement can stall the robotic vacuum, make cleaning less effective, or cause other undesirable events.

Axle guards or end caps can be provided adjacent one or more ends of each brush to keep hair and other similar matter from reaching the brush ends to prevent such matter from becoming entangled in the ends of the brushes and/or in the gearbox. However, the axle guards and end caps currently employed in robotic vacuums may not sufficiently prevent hair and similar matter from becoming entangled in the ends of the brushes and/or in the gearbox. Thus, robotic vacuums employing known axle guards and end caps may still stall due to entangled matter.

SUMMARY

The present teachings provide a rotating cleaning element configured to be inserted in a cleaning head compartment of a robotic vacuum. The rotating cleaning element includes a drive end including a drive protrusion configured to engage a drive mechanism of the cleaning head compartment, a bearing end and a shroud configured to surround at least a portion of the bearing end to lessen an amount of hair and similar matter that reaches the bearing, and a central member extending between the bearing end and the drive end.

The bearing end of the rotating cleaning element may further include a cylindrical sleeve surrounding a shaft of the rotating cleaning element, a circular flange adjacent the central member of the rotating cleaning element and extending radially outwardly from the sleeve of the central member, and a recess between a portion of the central member and the circular flange.

The shroud may include a first wall generally parallel to a central axis of the central member, a second wall extending generally perpendicular to the first wall, a third wall extending generally perpendicular to the second wall, and a fourth wall extending generally perpendicular to the third wall to define the interior of the shroud, and wherein a reservoir into which the hair and similar matter is collected is defined between the circular flange, the first wall of the shroud, the second wall of the shroud, and the sleeve.

The rotating cleaning element further includes a labyrinth passage between the recess and the reservoir, the labyrinth passage being a path between the recess and the reservoir at an outer diameter of the circular flange. The rotating cleaning element may further include a guard extending outwardly from the sleeve to an interior wall of the shroud. The circular flange, the guard and the shroud may define a first reservoir into which the hair and similar matter is collected.

The shroud may include a first wall generally parallel to a central axis of the central member, a second wall extending generally perpendicular to the first wall, a third wall extending generally perpendicular to the second wall, and a fourth wall extending generally perpendicular to the third wall to define the interior of the shroud.

The at least one guard may extend from the sleeve radially outwardly to the third wall of the shroud, the first reservoir being defined between the circular flange, the first wall of the shroud, the second wall of the shroud, a portion of the third wall of the shroud, the guard, and the sleeve.

The guard may extend from the sleeve radially outwardly toward the third wall of the shroud, the first reservoir being defined between the circular flange, the first wall of the shroud, the second wall of the shroud, the guard, and the sleeve. The rotating cleaning element may further include a first labyrinth passage between the recess and the first reservoir, the first labyrinth passage being a path between the recess and the first reservoir at an outer diameter of the circular flange. The guard, the sleeve and the shroud may define a second reservoir into which the hair and similar matter is collected.

The rotating cleaning element may further include a second labyrinth passage between the first reservoir and the second reservoir, the second labyrinth passage being a path between the first reservoir and the second reservoir at an outer diameter of the guard. The rotating cleaning element may be one of a main brush and a flapper brush.

The present teachings provide a cleaning head subsystem for a robotic vacuum, the cleaning head subsystem including a cleaning head compartment and at least one cleaning element. The cleaning element includes a bearing end and a first shroud configured to surround at least a portion of the bearing end and a sleeve thereof, a first reservoir being defined at least between a portion of the first shroud and the sleeve, a drive end comprising a drive protrusion configured to engage a drive mechanism of the cleaning head compartment, and a central member extending between the bearing end and the drive end. The drive end includes a second shroud configured to surround at least a portion of the drive end of the brush assembly and at least one guard extending radially outwardly from a central axis of the central member toward an interior of the second shroud, a second reservoir being defined at least between a portion of the second shroud and the guard.

The drive end may further include a retention device and a drive protrusion, the retention device being configured to limit axial motion of the cleaning element.

The retention device may include a plurality of interlocking members configured to engage one or more recesses in a drive gear that engages the drive protrusion.

The present teachings provide a cleaning head subsystem for a robotic vacuum, the cleaning head subsystem including a cleaning head compartment, a cleaning element assembly disposed within the cleaning head compartment, the cleaning element assembly including a main brush and a flapper brush, and a gearbox comprising a main brush drive gear to drive the main brush, a flapper brush drive gear to drive the flapper brush, and a first shroud configured to surround at least one of the main brush drive gear and the flapper brush drive gear.

The cleaning head subsystem may further include a second shroud configured to surround the other of the main brush drive gear and the flapper brush drive gear. The first shroud may be disposed over a drive end of the main brush in an installed position of the main brush, and the second shroud may be disposed over a drive end of the flapper brush in an installed position of the flapper brush. The cleaning head subsystem may further include a motor to drive the gearbox, and a third shroud extending between the motor and the gearbox. The third shroud may cooperate with the gearbox housing to create a recessed collection area for hair and similar matter.

Additional objects and advantages of the present teachings will be set forth in part in the description which follows, and in part will be obvious from the description, or may be learned by practice of the present teachings. The objects and advantages of the teachings will be realized and attained by means of the elements and combinations particularly pointed out in the appended claims.

It is to be understood that both the foregoing general description and the following detailed description are exemplary and explanatory only and are not restrictive of the present teachings, as claimed.

The details of one or more implementations of the disclosure are set forth in the accompanying drawings and the description below. Other aspects, features, and advantages will be apparent from the description and drawings, and from the claims.

DESCRIPTION OF DRAWINGS

Like reference symbols in the various drawings indicate like elements.

DETAILED DESCRIPTION

Some robotic vacuums include a cleaning head subsystem providing cleaning mechanisms for the robotic vacuum and comprising a brush assembly including a main brush and a flapper brush as illustrated in U.S. Pat. No. 7,636,982, the disclosure of which is incorporated by reference herein in its entirety. The main brush and the flapper brush can be mounted in recesses in the cleaning head compartment. Each main brush and flapper brush can comprise a central member (e.g., a cage) with first and second ends configured to mount the brush in the cleaning head compartment. One end of the brush/flapper is mounted to a gearbox or drive side of the cleaning head compartment, and the other end of the brush/flapper can comprise a bearing allowing the brush to rotate substantially freely when mounted to an opposite end of the cleaning head.

Axle guards or end caps can be provided adjacent one or more ends of each brush to lessen the amount of hair and similar matter that reaches and becomes entangled in the ends of the brushes and/or in the gearbox. Entanglement can stall the robotic vacuum, make cleaning less effective, or cause other undesirable events.

The present teachings therefore include a number of improvements for the ends of the main brush and/or the flapper brush that lessen the amount of hair and similar matter that reach and become entangled in the ends of the brushes and/or in the gearbox.

Figure 1:
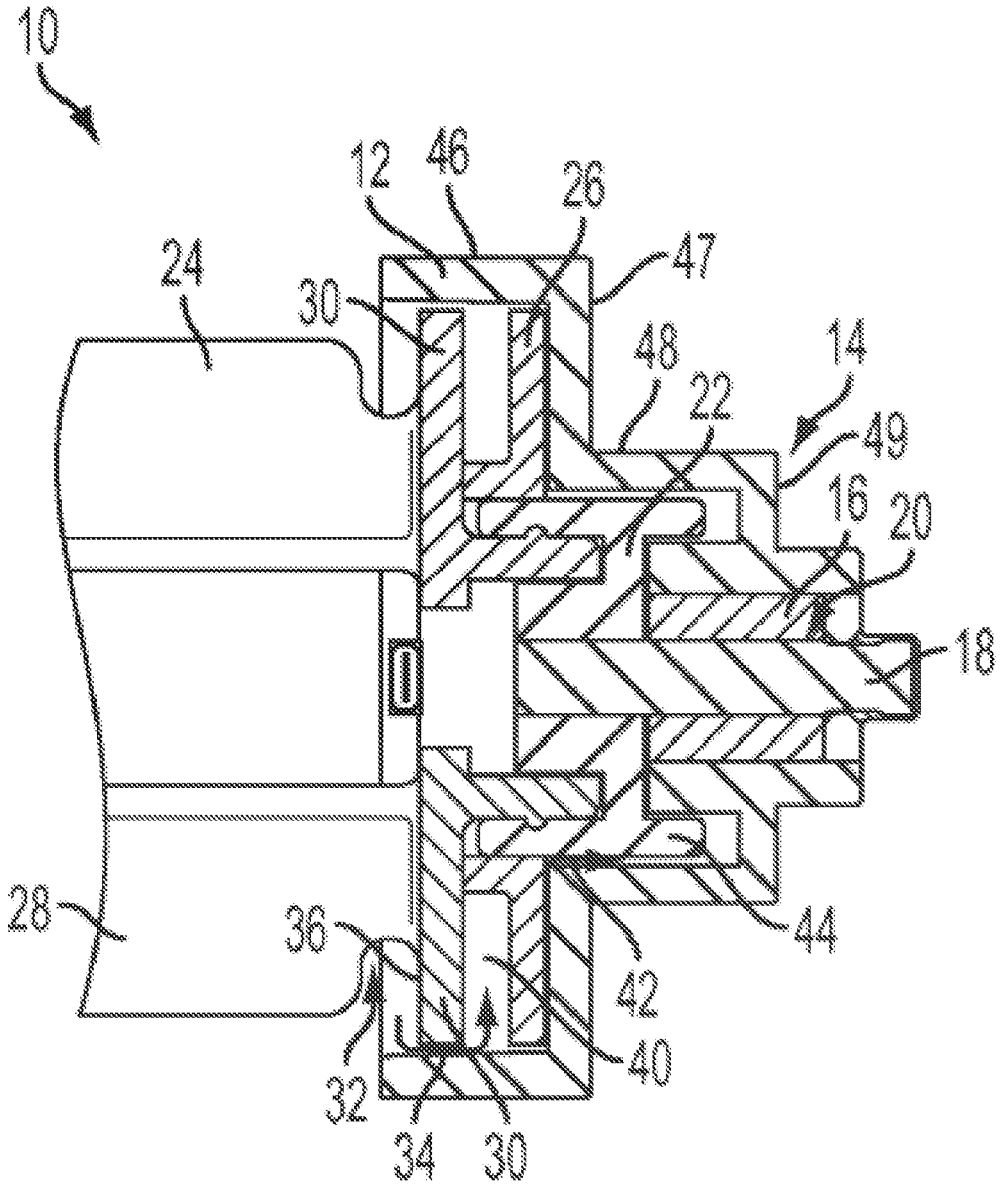
FIGS. 1-4 are cross-sectional views of various embodiments of a bearing end portion of a main brush for a robotic vacuum.

FIG. 1 illustrates a brush that may be a main brush or a flapper brush of a cleaning head subsystem, for example, that includes an embodiment of a shroud that can be employed in accordance with the present teachings to cover at least the bearing end of one or more of the main brush and the flapper brush of the cleaning head subsystem. In FIG. 1, the shroud 12 is shown covering a bearing end 14 of a brush 10, which is shown in FIG. 1 as a main brush. The shroud 12 is preferably not attached to the brush 10 and thus can remain stationary while the brush 10 rotates. The illustrated shroud 12 covers the bearing end 14 of the illustrated brush 10, and can optionally include an integrally molded or formed bearing 16 to reduce the total number of parts in the cleaning head subsystem. The bearing 16 need not, however, be integrally molded or formed in the shroud 12 and may be provided as a separate piece that, for example, fits within the shroud 12. The bearing 16 allows a shaft 18 of the brush 10 to rotate substantially freely when mounted in the cleaning head (shown more clearly in FIG. 15A, for example). If an integrally molded or formed bearing 16 is used with the shroud 12, an axle (or shaft 18) of the brush 10 is inserted into an aperture 20 in the shroud/bearing. When the bearing 16 is provided separate from the shroud 12, the brush shaft 18 can be inserted in the bearing 16 and then the bearing 16 can be inserted in the shroud 12, or the bearing 16 can be inserted in the shroud 12 before the shaft 18 is inserted into the bearing 16.

A shaft housing/cage cap 22 can be used to attach the shaft 18 to a cage 24 of the brush 10. The shaft housing/cage cap 22 provides protection for the bearing 16 from hair and other matter migrating into bearing 16. The shroud 12 includes a first wall 46 parallel to the cage 24 of the brush 10, a second wall 47 extending relatively perpendicularly from the first wall 46 toward the shaft 18, a third wall 48 extending relatively perpendicularly from the second wall 47 toward the bearing end 14, and a fourth wall 49 extending relatively perpendicularly from the third wall 48. A guard (e.g., an axle guard) 26 can surround the shaft housing/cage cap 22 to prevent hair and similar matter that has entered an interior of the shroud 12 from migrating outwardly toward the shaft housing/cage cap 22, the bearing 16, and the shaft 18. The guard 26 can extend perpendicularly with respect to the shaft 18 toward the first wall 46 of the shroud 12 and an outer face of the guard 26 can be maintained in close proximity to the second wall 47 to prevent hair and other matter from approaching the bearing 16.

FIG. 1 includes a circular flange 30, which may be similar to the guard 26 but spaced therefrom, a recess 32 lying between ribs 28 of the cage 24 and the circular flange 30, and a first labyrinth passage 34 from the recess 32, through a space between the outer diameter of the circular flange 30 and the shroud 12 to an internal reservoir 40 formed between the circular flange 30, the guard 26, and the first wall 46 of the shroud 12. The circular flange 30 is substantially parallel to the guard 26 and also extends perpendicularly with respect to the shaft 18 toward the first wall 46 of the shroud 12. Hair may collect around the cage ribs 28 and gather in the recess 32. Build-up of hair in the recess 32 and against a facing wall 36 of the circular flange 30 can provide a dam that prevents entry of hair and similar matter into the shroud interior once initial buildup has occurred, providing a location for hair and similar matter to collect where the hair and similar matter will not stall the robotic vacuum. The first labyrinth passage 34 provides a short passage from the recess 32 at a large outer diameter of the circular flange 30 to the reservoir 40. The short length of the first labyrinth passage 34 ensures that minimal torque is required if any hair or similar matter enters the shroud 12. In particular, if the labyrinth passage 34 was long, hair and other matter would be more likely to get stuck, causing a rise in torque and resulting in stalling the cleaning head. The internal reservoir 40 formed between the circular flange 30, the guard 26 and the first wall 46 of the shroud 12 provides a location for hair and similar matter that has entered the shroud 12 to collect where the hair and similar matter will not stall the robotic vacuum, i.e., the hair and other matter does not interfere with the bearing 16 when the hair, etc. is retained within the internal reservoir 40.

A second labyrinth passage 42 is formed between an exterior surface of the shaft housing/cage cap 22 and a complementary interior surface of the shroud 22 between the shaft housing/cage cap 22 and the second wall 47, the third wall 48 and the fourth wall 49 of the shroud, particularly around protrusions 44 of the shaft housing/cage cap 22 that extend into recesses in the shroud 12 interior. The path through the second labyrinth passage 42 is long and offers additional protection for the bearing 16 because the first labyrinth passage 34 has drastically reduced the amount of hair reaching the second labyrinth passage 42.

Figure 2:
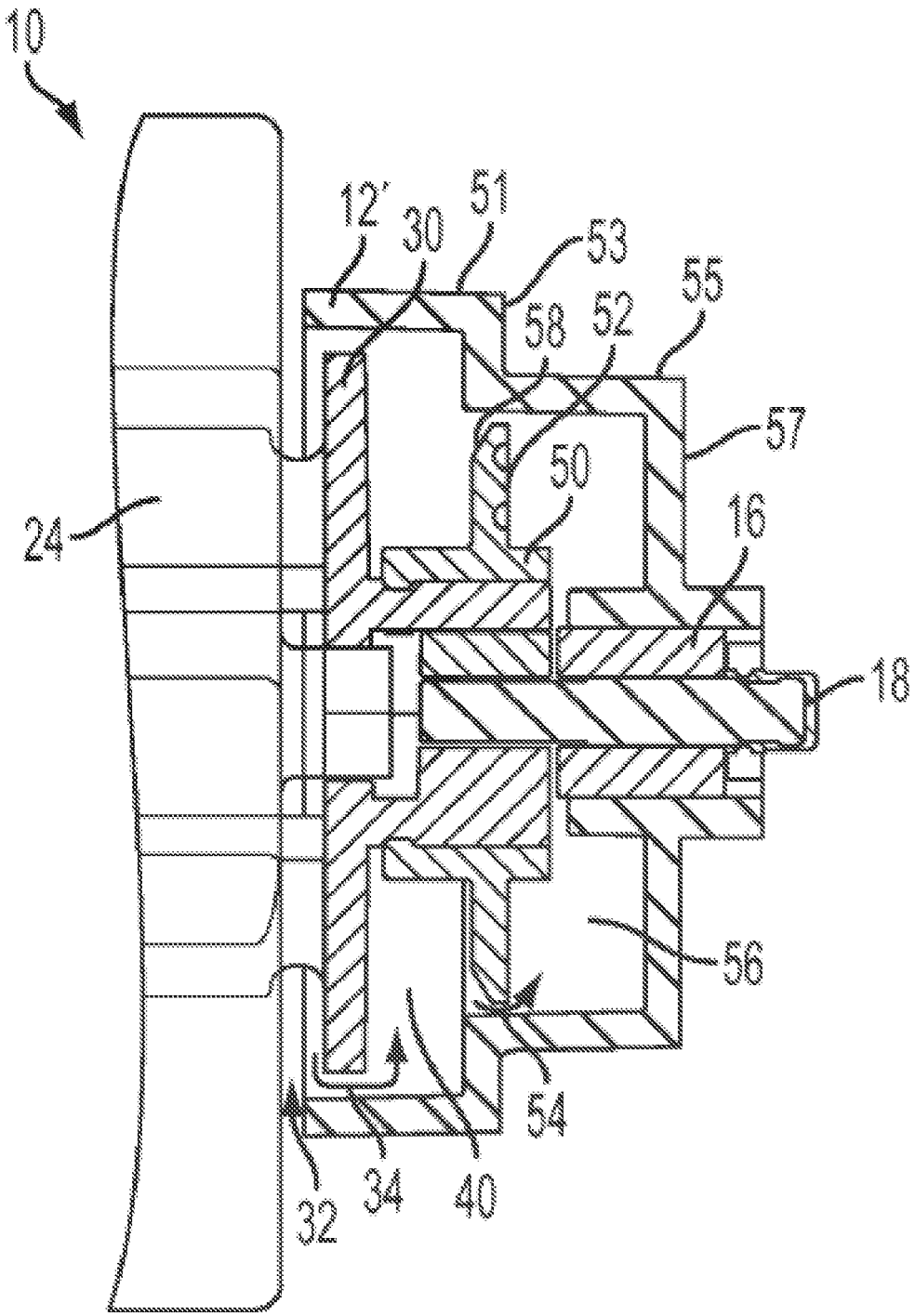

FIG. 2 illustrates another embodiment of a bearing end portion of a main brush for a robotic vacuum, wherein like reference numbers indicate like features. The brush 10 includes a shroud 12' and a circular flange 30 that is integrally formed with the brush cage 24. A recess 32 is provided between ribs of the brush cage 24 and the circular flange 30 in order to collect hair and other matter and provides a dam that prevents entry of the hair and other matter into the interior of the shroud 12'. The brush 10 also includes a sleeve 50 generally surrounding a shaft 18 of the brush 10 with a guard 52 extending perpendicularly from the sleeve 50 toward a wall of the shroud 12'. An end 58 of the guard 52 may be slightly tapered toward its distal end on the side opposite the bearing end 14 of the brush 10. Such tapering can be used to accommodate manufacturing tolerances.

The shroud 12' includes a first wall 51 extending generally parallel with a shaft 18 that holds a bearing 16, a second wall 53 that extends generally perpendicular to the first wall 51, a third wall 55 extending from the second wall 53 toward the bearing end 14 and a fourth wall 57 extending generally perpendicular to the third wall 55 toward the bearing 16. The guard 52 extends perpendicularly away from the shaft 18 and can be roughly aligned with the second wall 53, and can divide the interior space of the shroud 12' into a first reservoir 40 and a second reservoir 56. Similar to FIG. 1, a first labyrinth passage 34 is provided from the recess 32 to the first reservoir 40 at the outer diameter of the circular flange 30. The short length of the first labyrinth 34 ensures that minimal torque is required by minimizing the likelihood of hair and other matter getting stuck, as discussed above, should hair or other matter migrate into the gaps.

The second reservoir 56 is defined between the guard 52, the third wall 55 of the shroud 12', the first wall 57 of the shroud 12' and the bearing 16. The second reservoir provides an additional location to collect hair and other matter. The space of the reservoirs 40 and 56 allows hair to be kept loosely, which provides a web to tangle additional hair as the hair enters the reservoirs 40 and 56. A second labyrinth passage 54 is provided from the first reservoir 40 to the second reservoir 56 in a space between the end 58 of the guard 52 and wall 55. The second labyrinth passage 54 provides a short passage at a larger outer diameter to minimize the amount of hair and other matter that is able to enter further into the shroud 12' toward the bearing 16.

Figure 3:
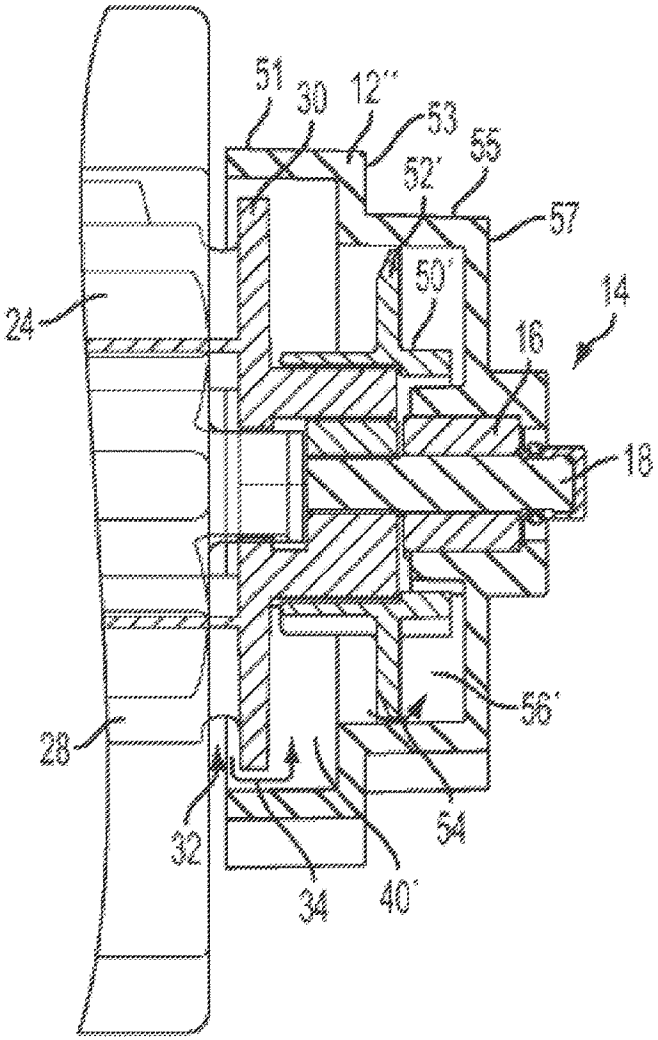

FIG. 3 illustrates another embodiment of a bearing end portion of a main brush for a robotic vacuum, wherein like reference numbers indicate like features. In FIG. 3, a circular flange 30 is provided and a recess 32 is defined between the circular flange 30 and the ribs 28 of the cage 24. The shroud 12" is similar to the shroud 12' illustrated in FIG. 2, with the first 51 and third 53 walls being relatively shorter. Thus, the shroud 12" of FIG. 3 is smaller than the shroud 12' of FIG. 2.

In the embodiment of FIG. 3, the sleeve 50' extends further toward the bearing end 14 than the sleeve 50 in FIG. 2. The guard 52', which extends perpendicularly from the sleeve 50', is provided and extends to the third wall 55, thus providing a larger first reservoir 40' and a smaller second reservoir 56', allowing more hair and other matter to collect in the first reservoir 40' after passing from the recess 32 through the first labyrinth passage 34. The first reservoir 40' is defined between the circular flange 30, the first wall 51, the second wall 53, a portion of the third wall 55, the guard 52' and the sleeve 50'. The second reservoir 56' is defined between the third wall 55 and the fourth wall 57 of the shroud 12" and is smaller than the first reservoir 40'. The embodiment of FIG. 3 may provide better performance than the embodiment of FIG. 2 in preventing hair from reaching the bearing 16.

Figure 4:
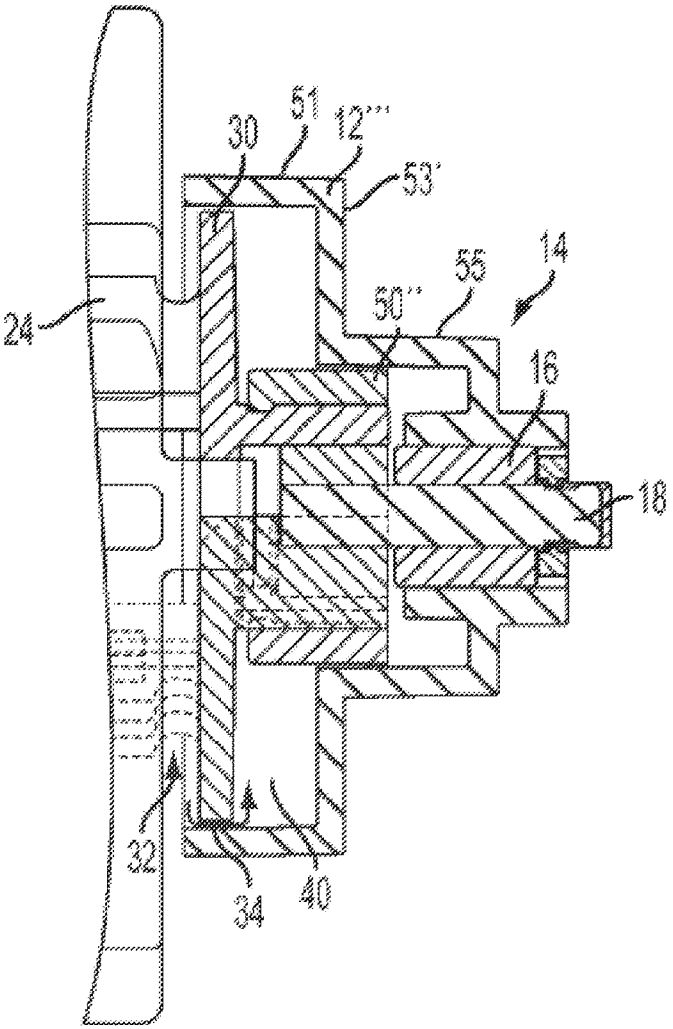

FIG. 4 illustrates another embodiment of a bearing end portion of a main brush for a robotic vacuum, wherein like reference numbers indicate like features. In FIG. 4, a circular flange 30 is provided and a recess 32 is defined between the circular flange 30 and the ribs 28 of the cage 24. The shroud 12'" is similar to the shroud 12' illustrated in FIG. 2 and the shroud 12" illustrated in FIG. 3, with the second wall 53 being relatively longer than the second walls of the shroud 12' and the shroud 12".

In the embodiment of FIG. 4, a sleeve 50" extends toward the bearing end 14. The sleeve 50" does not include a guard. The second wall 53' extends from the first wall 51 to the sleeve 50". A first reservoir 40 is defined between the circular flange 30, the first wall 51, the second wall 53' that extends to the sleeve 50" and the sleeve 50". The first reservoir 40 is similarly sized to that of the first reservoir 40 shown in FIG. 2. A first labyrinth passage 34 provides a path for the hair and other matter that is received in the recess 32 to travel to the first reservoir 40. Due to the configuration of the sleeve 50" without a guard and the configuration of the shroud 12'", only one main reservoir is provided to accumulate hair and other matter and prevent the hair and other matter from being received into the bearing 16. Thus, the embodiment of FIG. 4 may provide worse performance than the embodiments of FIGS. 2 and 3 of preventing hair from reaching the bearing 16. The benefits of using the embodiment of FIG. 4 will be discussed below in reference to FIG. 7.

Figure 5:
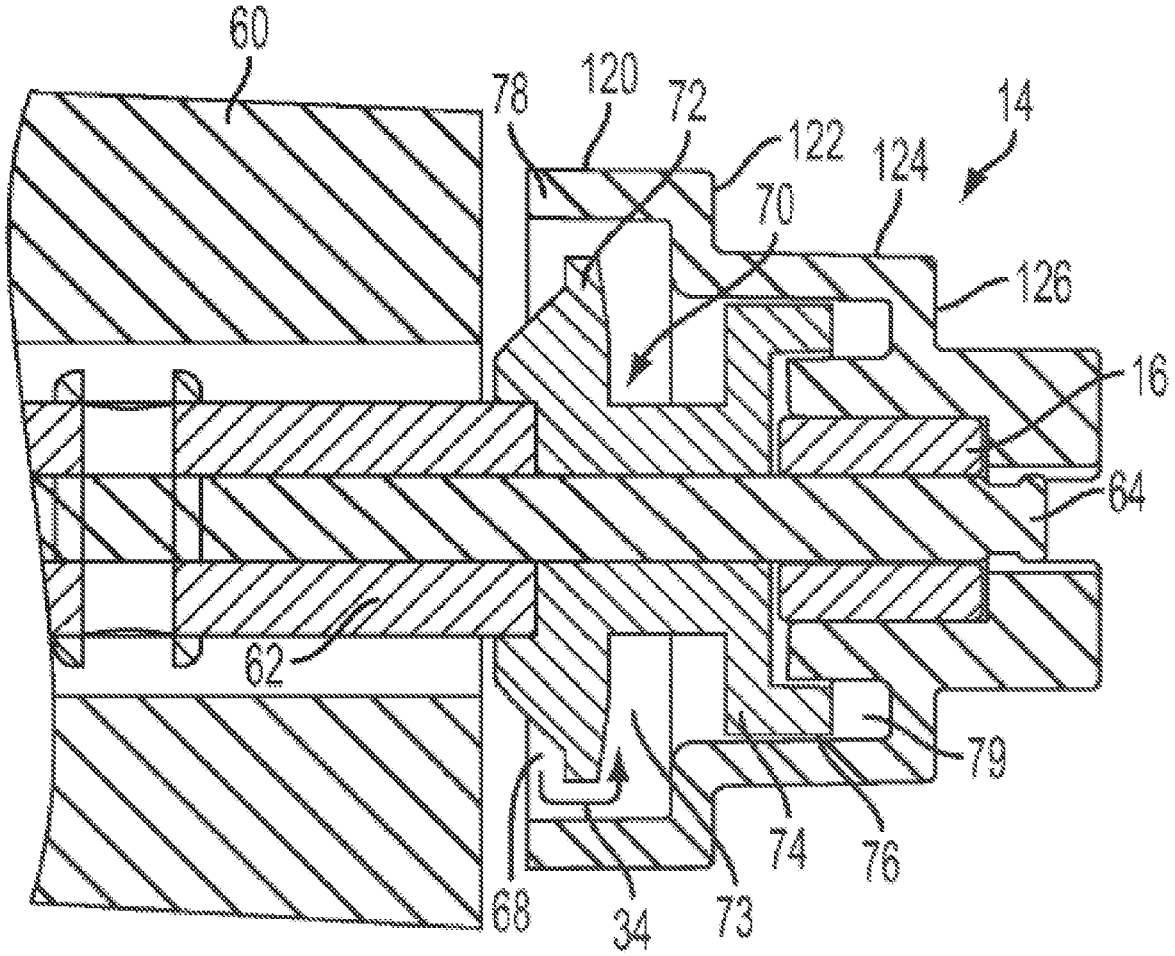
FIGS. 5 and 6 are cross-sectional views of various embodiments of a bearing end portion of a flapper brush for a robotic vacuum.

FIG. 5 illustrates another embodiment of a shroud that can be employed in accordance with the present teachings to cover at least the bearing end of one or more of the main brush and the flapper brush of a cleaning head subsystem. In FIG. 5 a shroud 78 is shown covering a bearing end 14 of a flapper brush 60. The flapper brush 60 includes a flapper shaft 62, for example with an overmold. The shroud 78 is preferably not attached to the brush 60 and thus can remain stationary while the brush 60 rotates. The illustrated shroud 78 can optionally include an integrally molded or formed bearing 16 to reduce the total number of parts in the cleaning head subsystem. The bearing 16 need not, however, be integrally molded or formed in the shroud 78 and may be provided as a separate piece. The bearing 16 allows the brush shaft 64 to rotate substantially freely when mounted in the cleaning head compartment. If an integrally molded or formed bearing 16 is used with the shroud 78, an axle (or shaft) 64 of the brush 60 is inserted into an aperture in the shroud/bearing. When the bearing 60 is provided separate from the shroud 78, the brush shaft 64 can be inserted in the bearing 60 and then the bearing 60 can be inserted in the shroud 78, or the bearing 60 can be inserted in the shroud 78 before the shaft 64 is inserted into the bearing 60.

A shaft housing 70 can surround the axle (or shaft) 64 adjacent at least the bearing end 14 of the brush 60 and include a first flange 72 and a second flange 74 with a recessed area 73 therebetween. A relatively large gap 68 is formed between the first flange 72 of the shaft housing 70 and an adjacent interior surface of the shroud 78. This gap 68 can allow hair and similar matter to enter the recessed area 73 of the shaft housing 70 that is located between the first flange 72 and the second flange 74, providing a location at the recessed area 73 for hair and similar matter to collect where the hair and similar matter will not stall the robotic vacuum. A short labyrinth passage 34 between an exterior surface of the shaft housing 72 and a complementary interior surface of the shroud 78 from the large gap 68 to the recessed area 73 provides a short passage at a large outer diameter of the shaft housing 72. The short length of the passage 34 ensures that minimal torque is required by minimizing the likelihood of hair and other matter getting stuck, as discussed above, if any hair or similar matter enters the shroud. The shaft housing cap 70 includes protrusions 76 extending from the second flange 74 into recesses 79 in the shroud 78 interior. As passage from the gap 68 into the recessed area 73 and around the protrusions 79 into the recesses 79 is long and difficult, additional protection is provided for the bearing 16.

Figure 6:
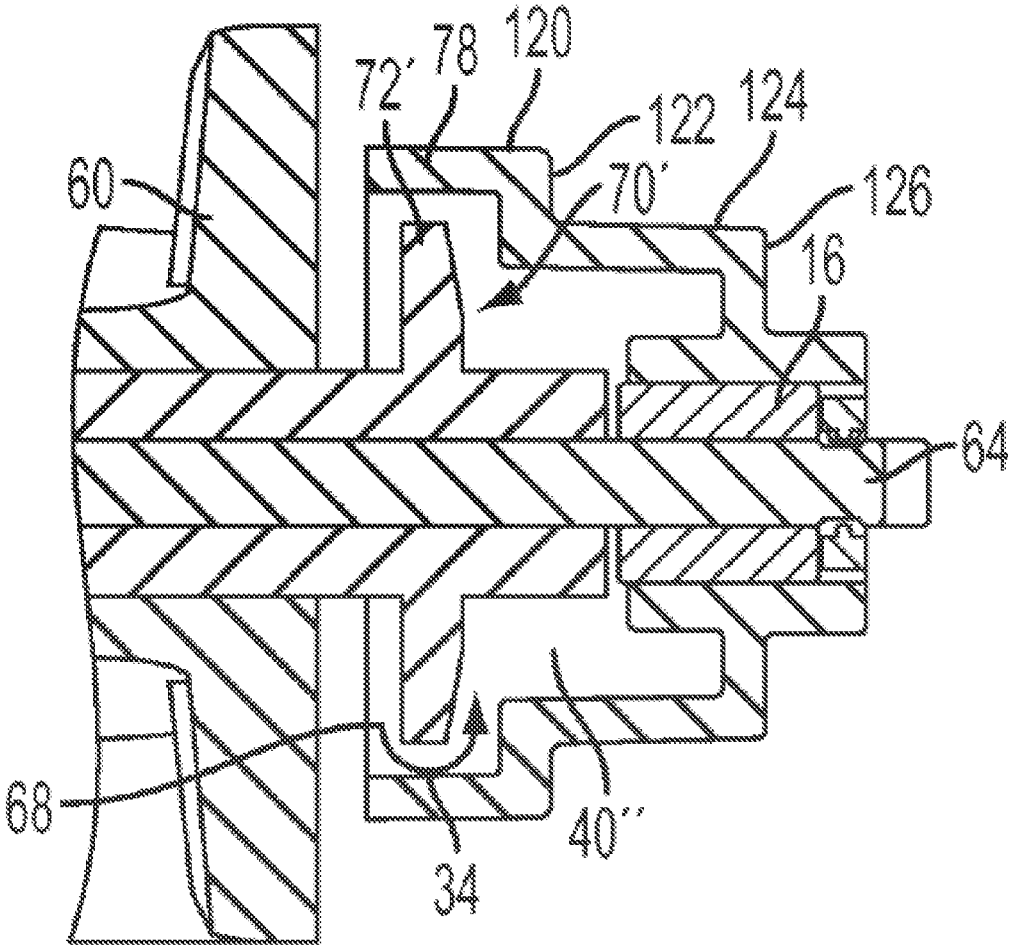

FIG. 6 illustrates an alternative embodiment of the shroud employed to cover at least the bearing end of one or more of the main brush and the flapper brush of a cleaning head subsystem. The structure of the bearing 16, shroud 78 and axle or shaft 64 is similar to that disclosed in FIG. 5. In FIG. 6, a shaft housing 70' that includes a sleeve and a guard 72' is provided. The guard 72' extends from the sleeve portion of the shaft housing 70' toward the shroud 78. The shroud 78 includes a first wall 120 extending parallel to the shaft 64, a second wall 122 extending generally perpendicular to the first wall 120, a third wall 124 extending generally perpendicular to the second wall 122, and a fourth wall 126 extending generally perpendicular to the third wall 124. A recess 68 is formed between the guard 72' and the brush 60. Hair collects between the flapper brush 60 and the guard 72' and provides a dam which prevents hair entry into the shroud 78 once initial buildup has occurred. A labyrinth passage 34 is formed from the recess 68 between the guard 72' and the shroud 78 interior at first wall 120 and to a reservoir 40". The reservoir 40" receives hair through the labyrinth passage 34 and is relatively large, being defined between a portion of the first wall 120 of the shroud 78, the second wall 122, the third wall 124 and the fourth wall 126. The reservoir 40" provides a location for hair and other matter to collect.

One skilled in the art will appreciate that a shroud as illustrated in FIGS. 1-4 or FIGS. 5 and 6 can be employed in a similar manner on the drive end of one or more of the main brush or the flapper brush in accordance with the present teachings.

Figure 7B:
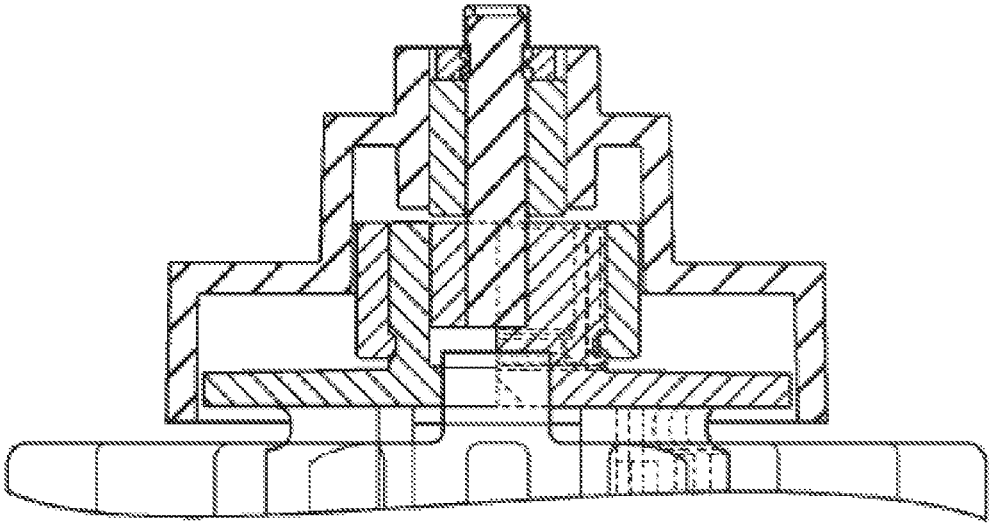
FIGS. 7A and 7B are cross-sectional views of exemplary embodiments of a drive end portion and a bearing end portion, respectively, of a brush for a robotic vacuum.
Figure 7A:
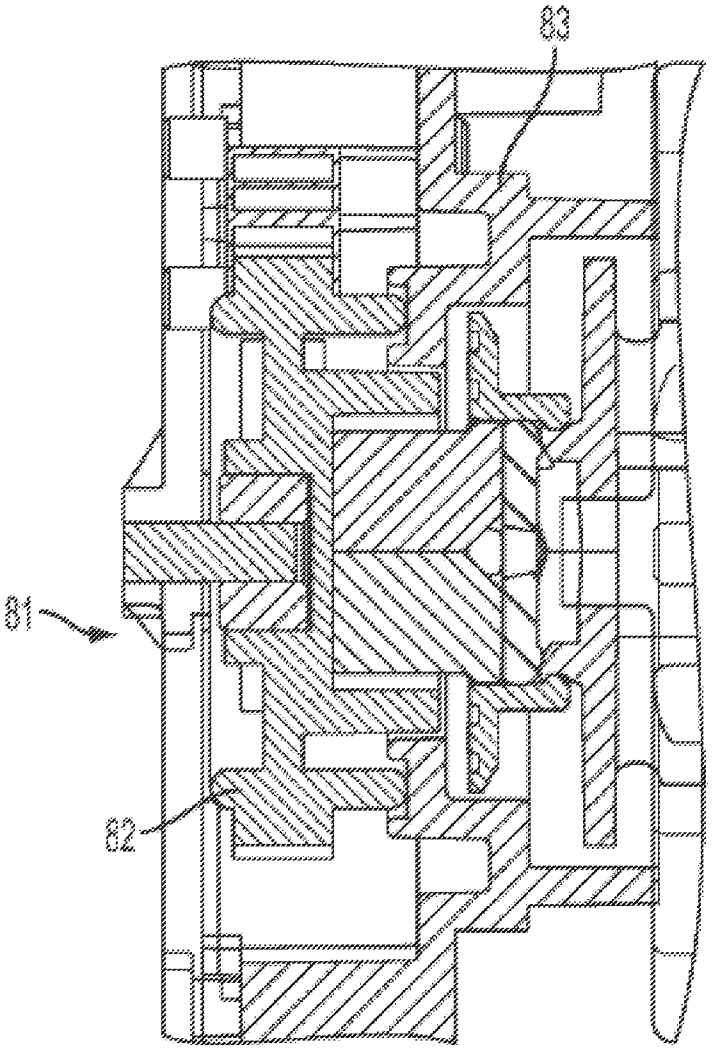

FIGS. 7A and 7B are cross-sectional views of at least one embodiment of a drive end portion and a bearing end portion, respectively, of a brush for a robotic vacuum in accordance with the present teachings. In general, it is preferable for hair and other matter to collect in the bearing end (see FIG. 7B) of the brush instead of being fed into the gearbox of the brush's drive end (see FIG. 7A). Therefore, in a preferred embodiment, the drive end portion shown in FIG. 7A includes an embodiment of the shroud shown with a guard, for example, guard 52 or 52' in FIGS. 2 and 3, while the bearing end portion shown in FIG. 7B includes an embodiment with only the sleeve, for example, sleeve 50" in FIG. 4. As the addition of the guard provides additional protection for the gearbox and as the bearing end does not include a guard, in this embodiment, the hair and other matter tend to migrate away from the drive end (FIG. 7A) and toward the bearing end (FIG. 7B), which is preferable to avoid gearbox failures and to direct the hair and other matter to the end at which a user is able to clean the brushes. As the bearing end preferably does not include the guard, more hair and other matter tend to migrate into the bearing end and be collected in reservoir(s) in the bearing end.

The drive end of the brush includes a gearbox 81 having a gear 82. A shroud 83 surrounds the drive end of the brush and is incorporated into the gearbox 81 at the drive end (see FIG. 16, for example). A continuous stationary shroud housing allows for full 360 degree rotation of the brushes within the stationary shroud. However, it is noted that a shroud need not provide a full 360 degree rotation and may provide less than 360 degrees of rotation for received brushes. Because breaks in the shroud surface promote catching of hair, it is preferable for the gearbox housing to have a single continuous shroud within breaks in the shroud surface.

Figure 8A:
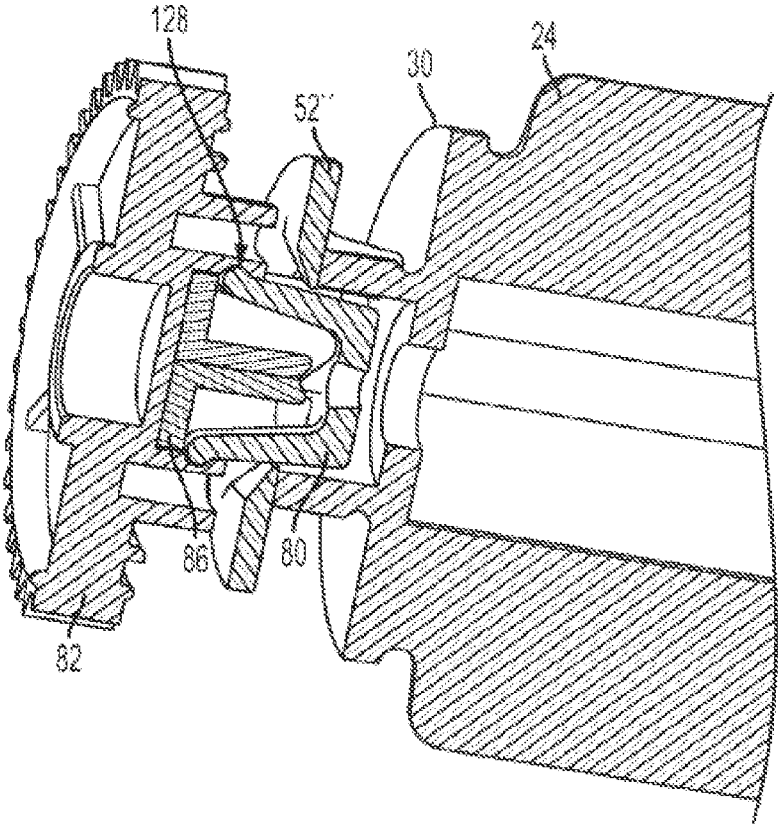
FIG. 8A is a perspective cross-sectional view of an exemplary embodiment of a drive end portion of a brush, including a retention device.
Figure 8B:
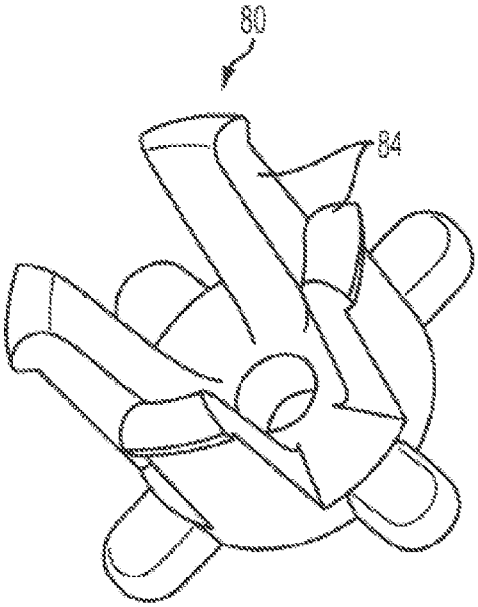
FIG. 8B is a perspective view of the retention device of FIG. 8A.

FIG. 8A is a perspective cross-sectional view of a drive end portion of a brush connected with a drive gear of the cleaning head, including a retention device in accordance with the present teachings, and FIG. 8B is a perspective view of the retention device of FIG. 8A in accordance with the present teachings. In FIG. 8A, a retention device 80 is shown housed internal to the cage 24 of the brush 10. While the retention device 80 is shown attached to the main brush 10, it will be understood by one of ordinary skill in the art that the retention device may also be utilized with a flapper brush. The retention device 80 is positioned between a circular flange 30 and a gear 82 to lock the brush to the gear 82. A sleeve 50'" having a guard 52" extending from the sleeve 50'" may be provided between the circular flange 30 and the gear 82.

The retention device 80 may be, for example, an internal snapping device that is able to be retained to the gear 82. The retention device 80 may include a plurality of interlocking members 84 extending away from the cage 24 when the retention device 80 is in an engaged position. The retention device 80 is internally disposed between the sleeve 50'" and the guard 52" and is received within a drive protrusion 86. When the drive protrusion 86 is inserted into a main recess of the gear 82 (see also gear 120 in FIG. 17), the interlocking members 84 are each received into a reception recess 128 within the interior of the gear 82. The retention device 80 limits the axial motion of the brush 10 toward its bearing end, which reduces the ability of hair and debris to enter the drive end of the brush by reducing gaps at the drive end.

Figure 16:
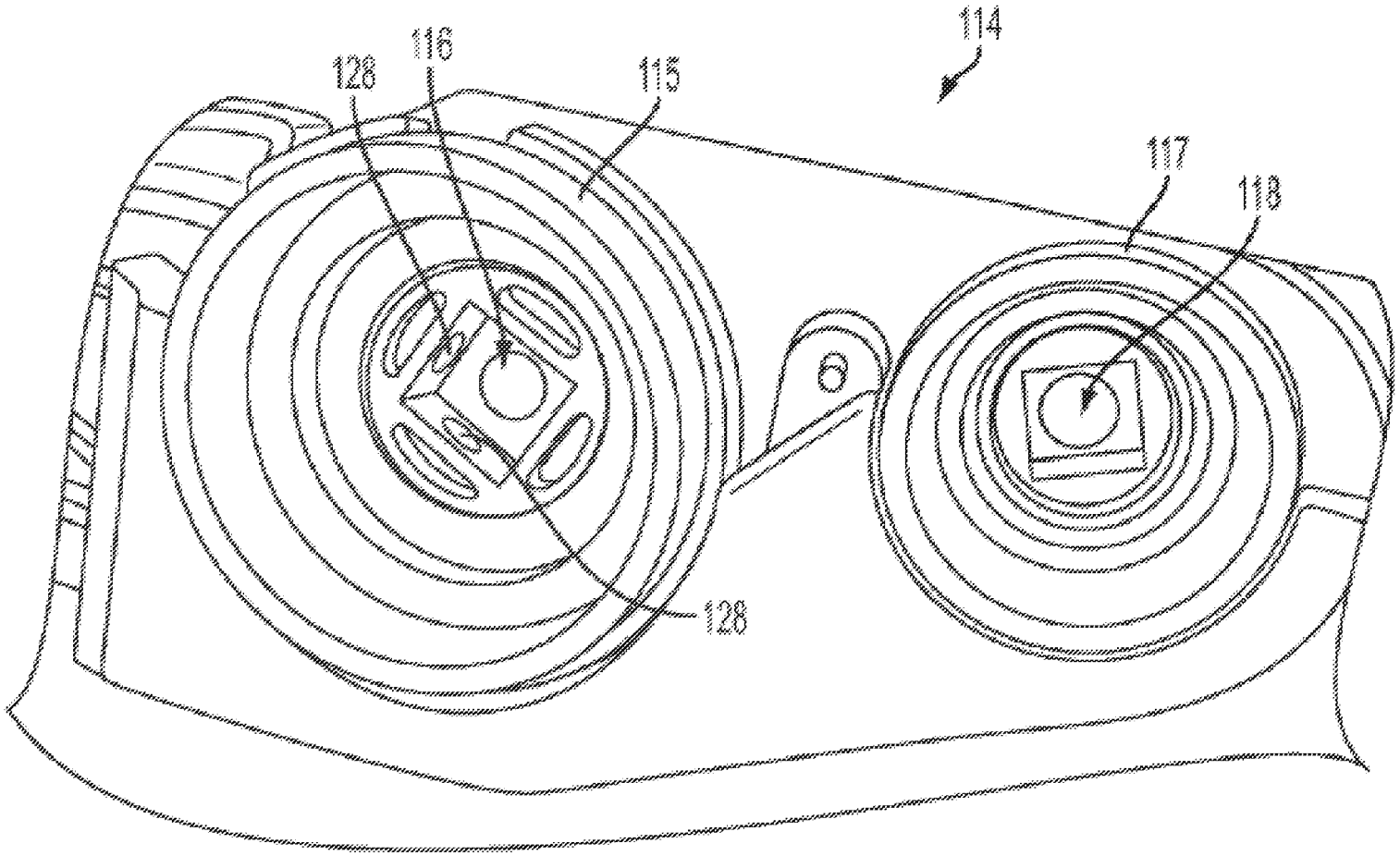
FIG. 16 is a front view of the drive end of the cleaning head compartment.
Figure 17:
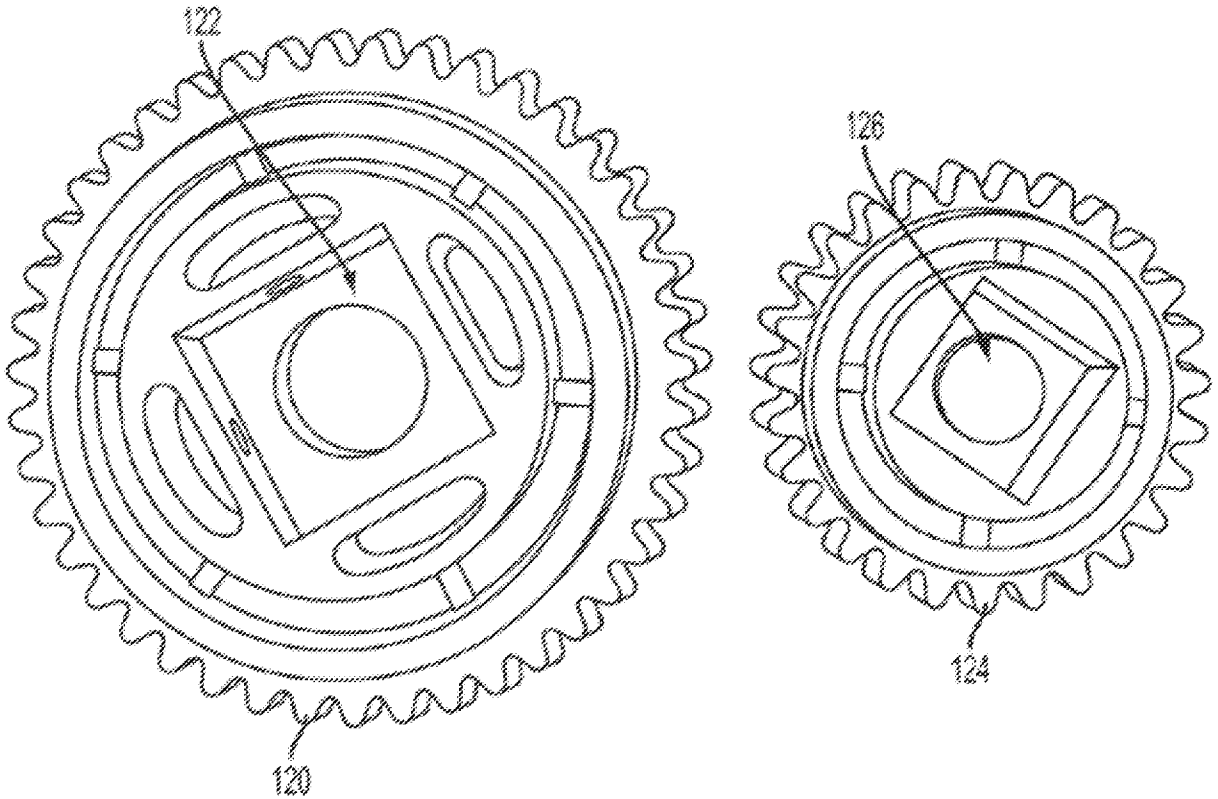
FIG. 17 is a top view of gears for the main brush and the flapper brush.

The drive protrusion 86 can engage a gear recess, such as, e.g., gear recess 122 for gear 120 shown in FIGS. 16 and 17, which is disposed within a shroud head 114 including a shroud portion, such as shroud 115 for the main brush 10 and a shroud portion, such as shroud 117 for the flapper brush 60, as shown in FIG. 16, for example. While the gear 120 shown in FIG. 17 and similarly shown as gear 82 in FIG. 8A, which are used with the main brush 10, is illustrated in connection with the retention device 80, it may be understood by those of ordinary skill that the retention device 80 may also or alternatively be used with the flapper brush 60 and thus may be used with the gear 124 engaged with the shroud 117 and having a gear recess 126.

In addition, although the retention device 80 is shown being housed internal to the brush cage 24 with the interlocking members 84 being retained by reception recesses 128 within the gear 82, one of ordinary skill would recognize that the retention device could alternatively be provided at the gear 82, with corresponding reception recesses located at the brush cage 24 to be retained at the brush end.

Figure 9:
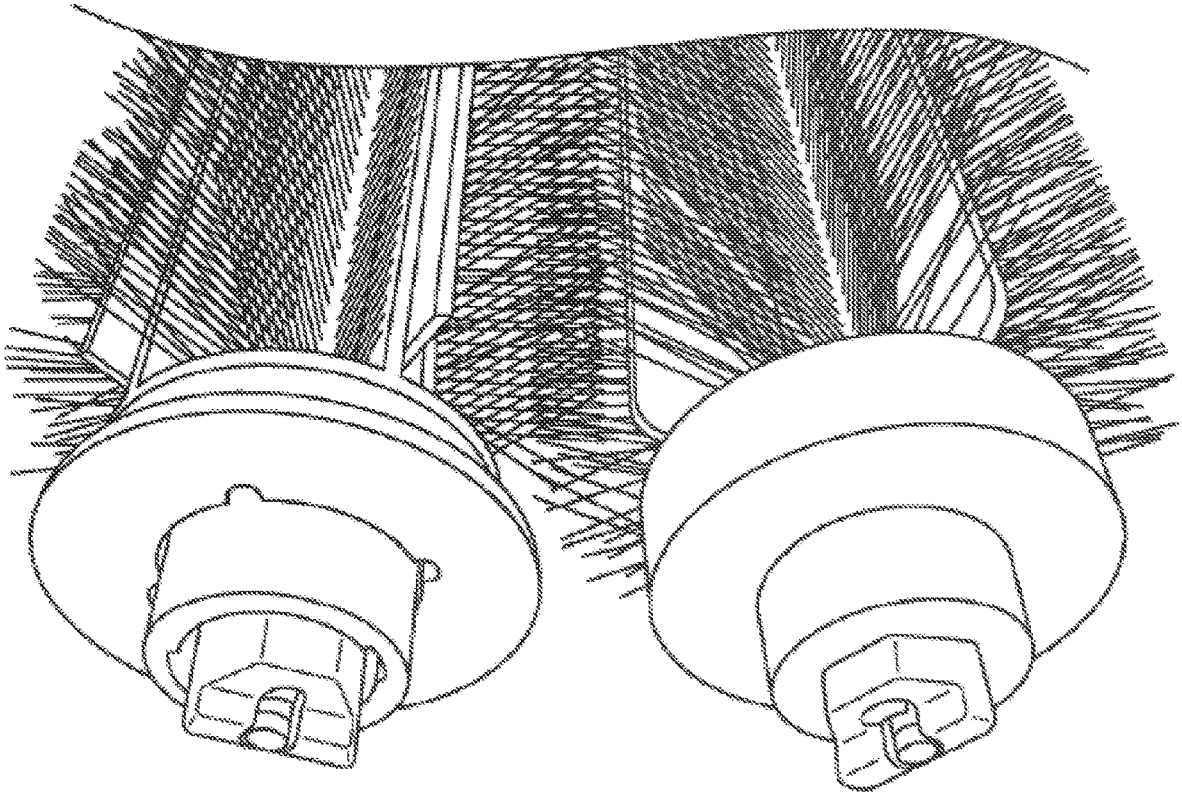
FIG. 9 is a perspective view of an exemplary bearing end portion of an existing robotic vacuum brush (left) and an exemplary bearing end portion of a robotic vacuum brush (right).

Certain embodiments of the present teachings contemplate providing a shrouded end for a brush as set forth in the above exemplary embodiments, which has a size and shape allowing it to be backward compatible with existing cleaning heads. FIG. 9 shows how a bearing end of a shrouded main brush (right) can be sized and shaped like a bearing end of an existing non-shrouded main brush (left) for backward compatibility with existing cleaning heads into which the bearing end of the main brush is mounted, noting that a third wall and a fourth wall (such as walls 48 and 49 shown in FIG. 1, for example).

Figure 10A:
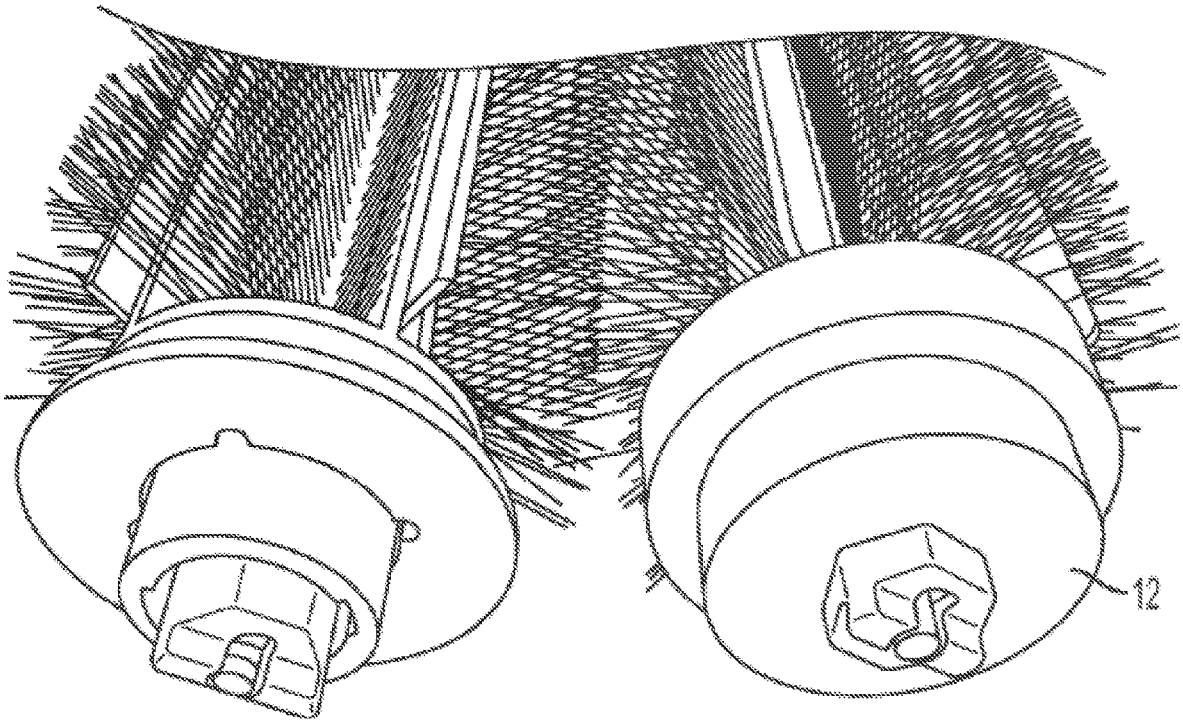
FIG. 10A is a perspective view of a bearing end portion of an existing robotic vacuum brush (left) and an embodiment of a bearing end portion of a robotic vacuum brush in accordance with an exemplary embodiment of the present teachings (right).
Figure 10B:
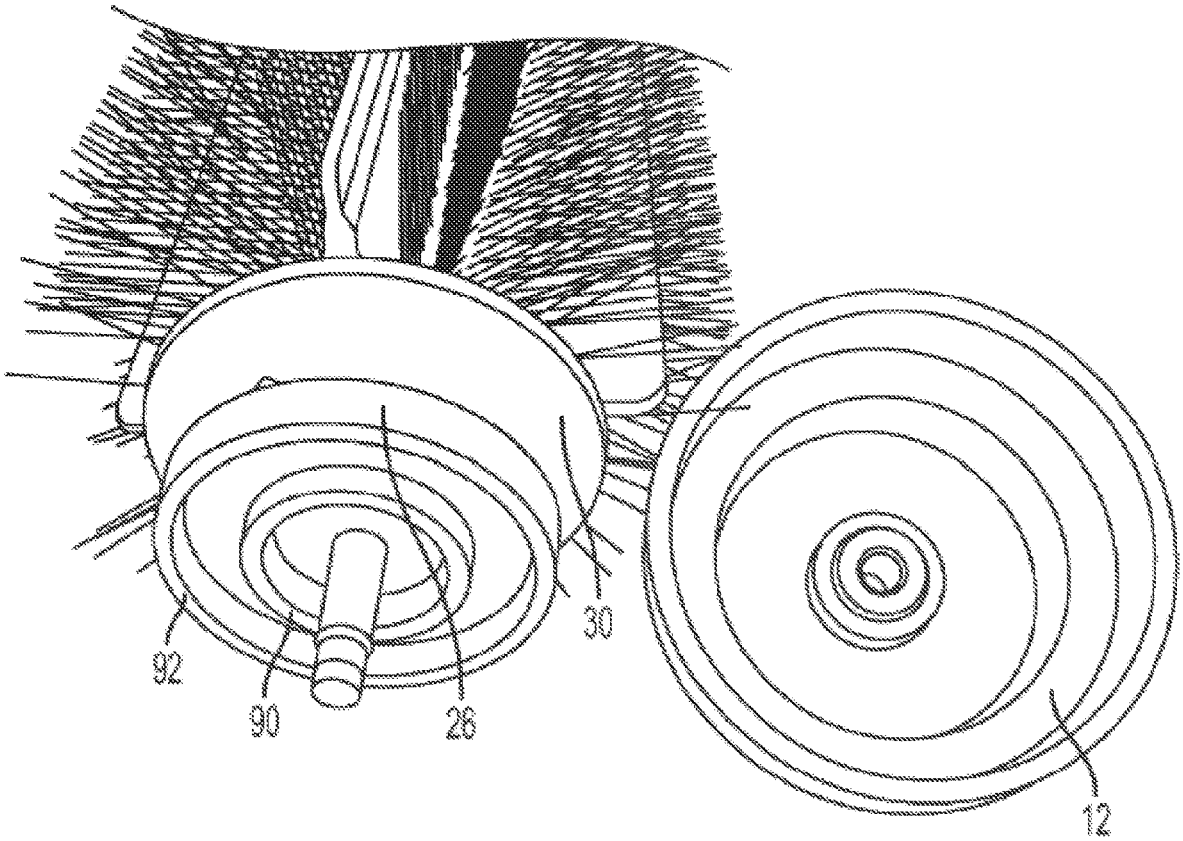
FIG. 10B is a perspective view of the brush bearing end portion embodiment shown on the right side of FIG. 10A, with the shroud removed.

FIG. 10A shows an embodiment of a bearing end of a shrouded main brush (right) with improved hair-resistance properties but which is not backward compatible with existing cleaning heads because it does not have the same size and shape as existing main brush bearing ends (left). The shroud, which may be similar to shroud 12 in FIG. 1, for example, is larger because the brush guard includes a non-removable guard 26 with a large diameter (and optionally with both a first protrusion 90 and a second protrusion 92 for engagement with a second recess of the shroud to form an additional labyrinth) as illustrated in FIG. 10B. An alternative embodiment can include, for example, a shroud that has a third wall and a fourth wall (such as walls 55 and 57 in FIG. 2, for example) that are sized to define a relatively larger diameter than the diameter of the third and fourth walls shown in FIG. 9.

Figure 11A:
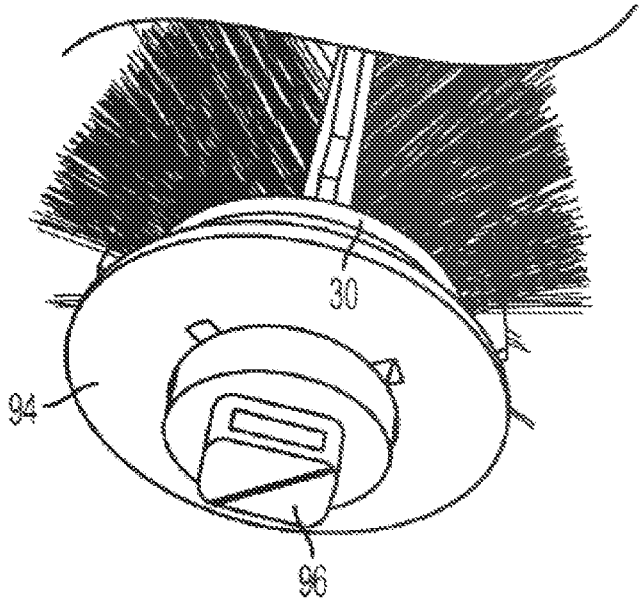
FIG. 11A is a perspective view of a drive end portion of an existing robotic vacuum brush.
Figure 11B:
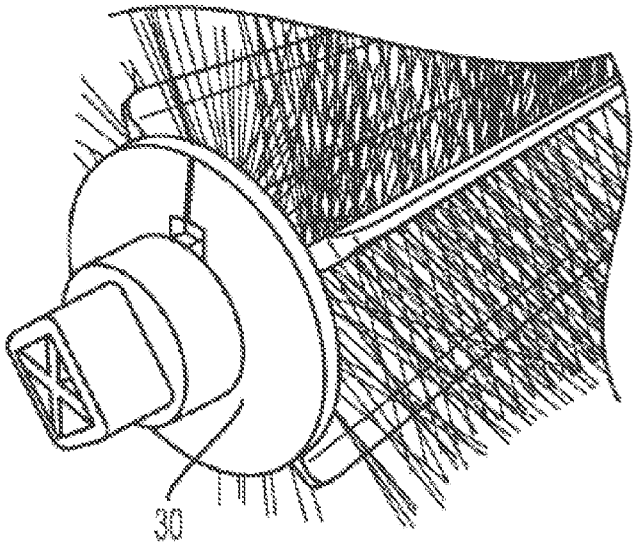
FIG. 11B is a perspective view of an embodiment of a drive end portion of a robotic vacuum brush.
Figure 11C:
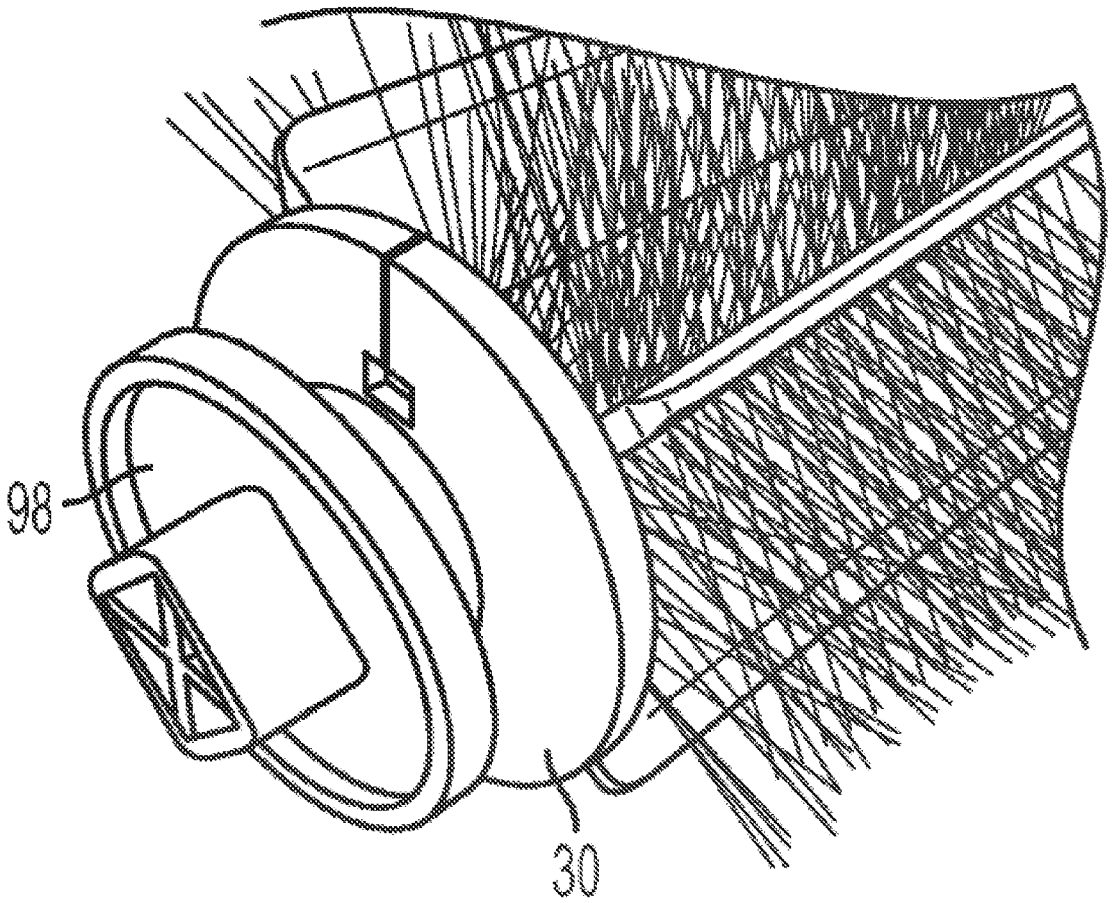
FIG. 11C is a perspective view of an embodiment of a drive end portion of a robotic vacuum brush.

FIG. 11A shows a drive end of an existing main brush, FIG. 11B shows an embodiment of a drive end of a main brush in accordance with the present teachings, and FIG. 11C shows another embodiment of a drive end of a main brush in accordance with the present teachings. As shown, the drive end of the brush can include a drive protrusion 96, e.g., a square-shaped drive protrusion, for engagement with a complementary recess 122 (shown in FIG. 17) of the cleaning head compartment's brush drive mechanism. A removable guard 94 or end cap as illustrated in FIG. 11A can be provided between the square-shaped drive protrusion 96 and a brush cage 24 in the existing brush drive end illustrated in FIG. 11A or in the embodiment of FIG. 11B. The embodiment of FIG. 11B can allow a wider recessed area between a removable end cap and the circular flange 30 of the cage 24, providing a larger area for hair and similar matter to collect where it will not stall the robotic vacuum.

FIG. 11C shows an embodiment of a vacuum brush in accordance with the present teachings that includes a non-removable guard 98 having a protruding lip at its outer perimeter and creating a wide recessed area between the non-removable guard 98 and the circular flange 30 of the cage 24, providing a larger area for hair and similar matter to collect where it will not stall the robotic vacuum. Due to the diameter of the illustrated non-removable guard, this brush embodiment may not be backward compatible with existing cleaning heads.

Figure 12B:
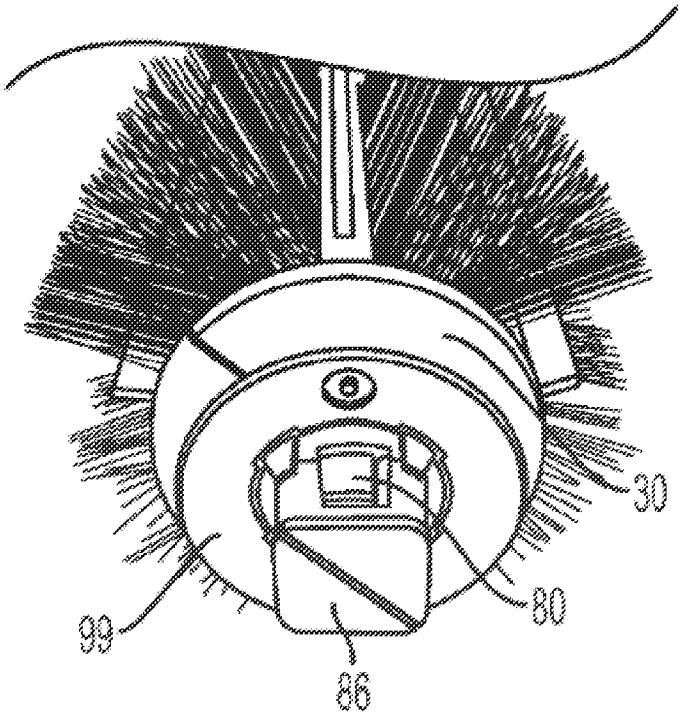
FIG. 12B is a front perspective view of an embodiment of a drive end portion of a robotic vacuum brush.
Figure 12A:
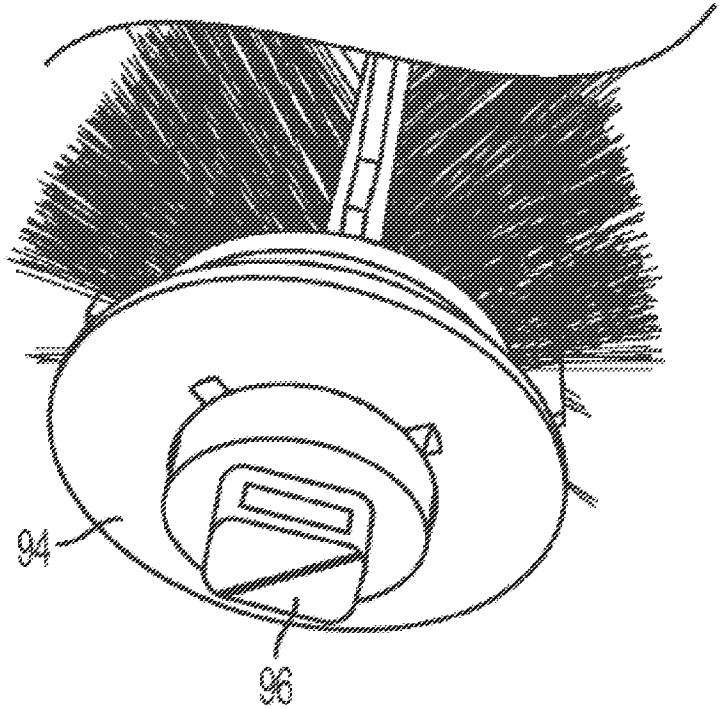
FIG. 12A is a front perspective view of a drive end portion of an existing robotic vacuum brush.

FIG. 12A is a front perspective view of a drive end portion of an existing robotic vacuum brush corresponding to FIG. 8A discussed above, and FIG. 12B is a front perspective view of an embodiment of a drive end portion of a robotic vacuum brush in accordance with the present teachings. The existing brush shown in FIG. 12A includes a removable guard 94 and a square drive protrusion 96. In contrast, the brush according to the present teachings shown in FIG. 12B includes a non-removable sleeve (not visible in FIG. 12A) with a guard 99 extending therefrom. The retention device 80 can be seen through an aperture in the illustrated drive end protrusion 86.

Figure 13:
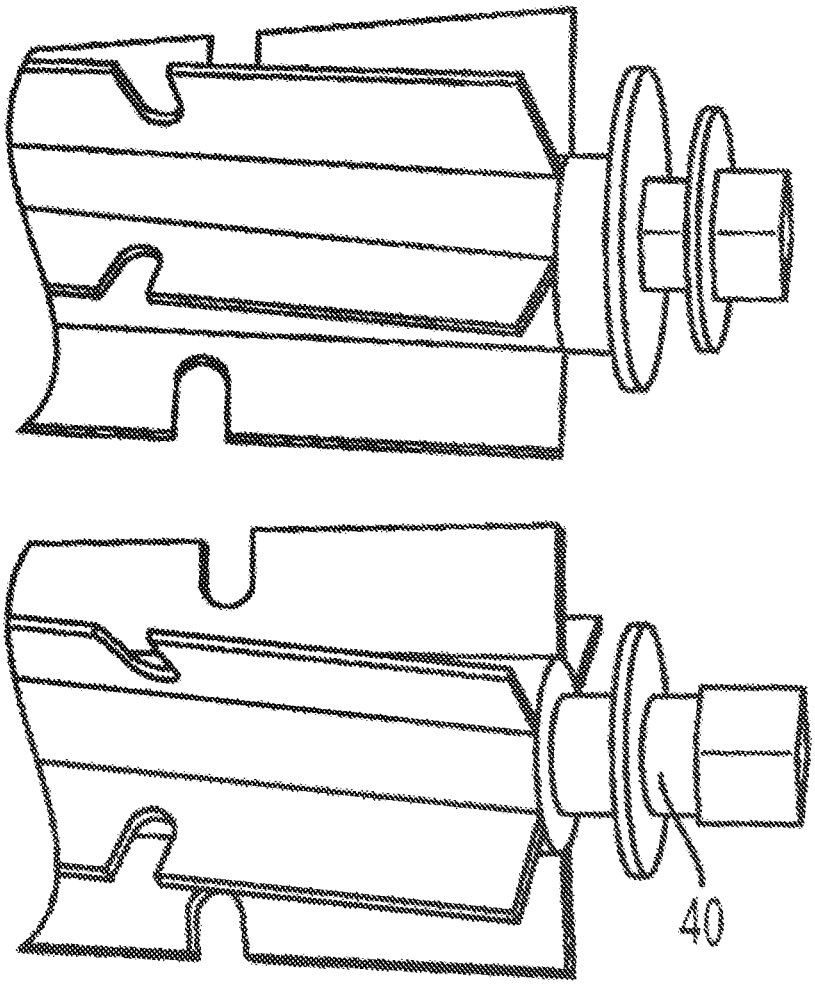
FIG. 13 is a side perspective view of an exemplary embodiment of an end portion of a robotic vacuum flapper brush (top) and a side perspective view of another exemplary embodiment of an end portion of a robotic vacuum brush (bottom).

FIG. 13 is a side perspective view of an exemplary embodiment of an end portion of a robotic vacuum flapper (top) and a side perspective view of another exemplary embodiment of an end portion of a robotic vacuum flapper (bottom). The drive end of the flapper brush is shown. The top flapper brush may include two flange or guard portions, while the bottom flapper brush may include a single flange or guard portion between the central member of the brush and the drive protrusion, with a reservoir 40 being defined between the single flange or guard portion and the shroud when the shroud is installed over the drive end of the flapper brush. It may be preferable to include a single flange or guard because the accumulation of the hair and other matter between the guards may cause melting of parts due to the increased humidity due to hair buildup.

Figure 14A:
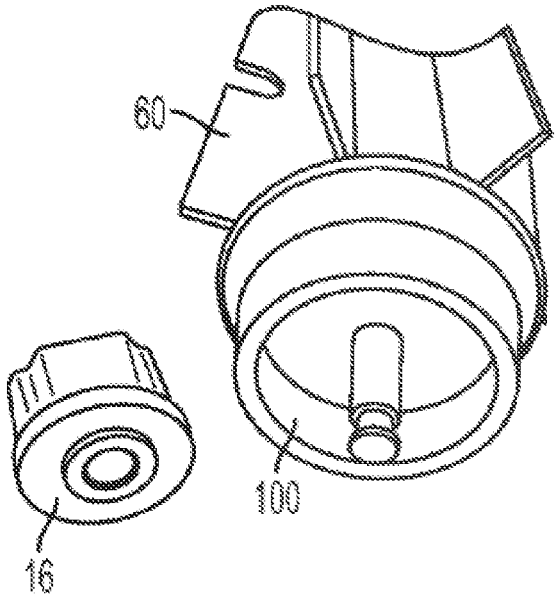
FIG. 14A is a perspective view of a bearing end portion of an existing flapper brush, with the bearing removed from the brush axle.
Figure 14B:
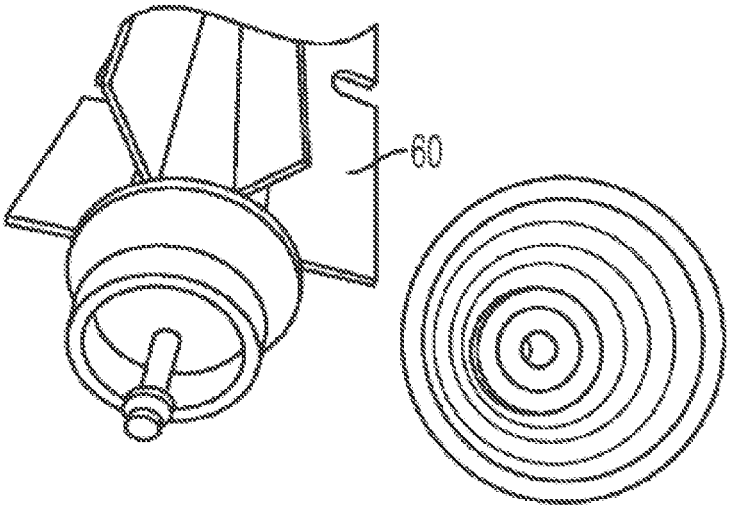
FIG. 14B is a perspective view of an embodiment of a bearing end portion of a brush with the shroud removed from the brush axle.
Figure 14C:
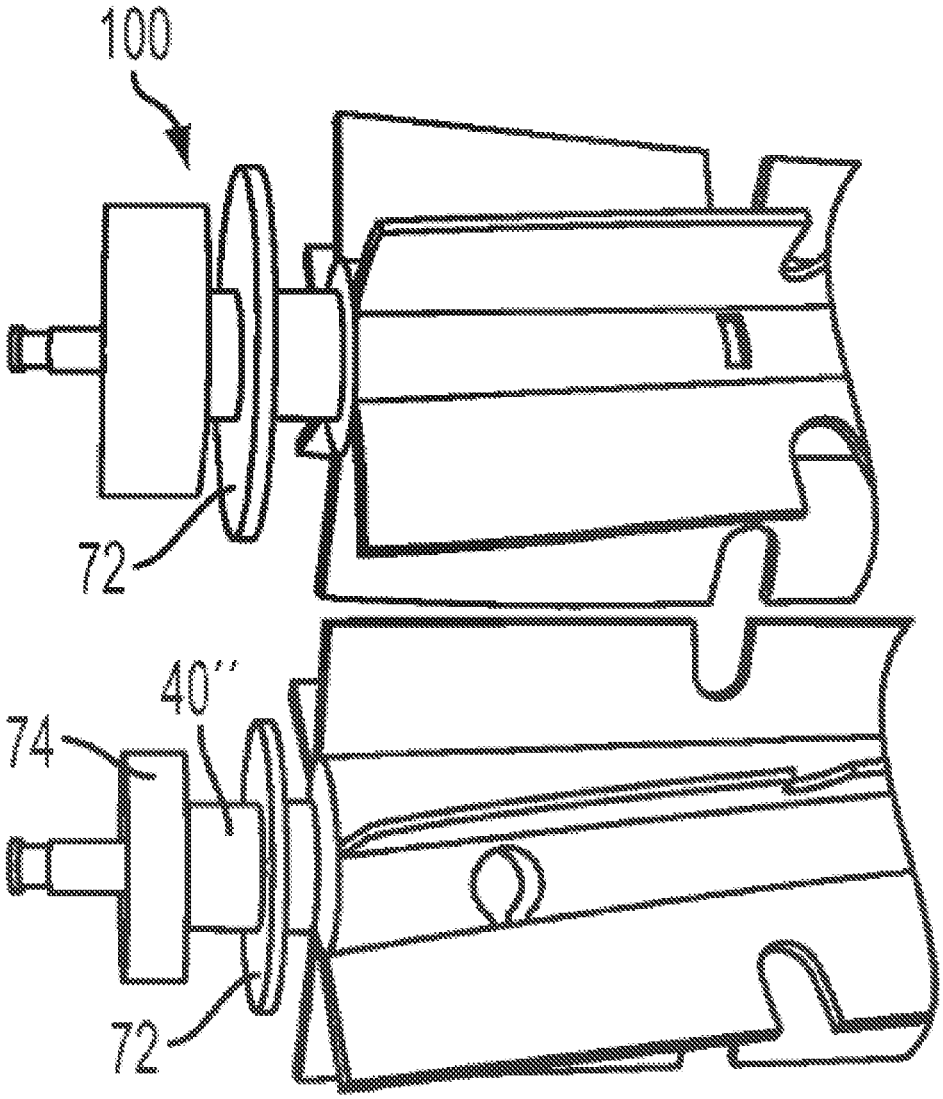
FIG. 14C is a top view providing a comparison of an existing robotic vacuum brush bearing end portion (top) and an embodiment of a robotic vacuum brush bearing end portion (bottom).

FIG. 14A illustrates an existing bearing end of a flapper brush. The bearing 16 is shown detached, but can be inserted on the axle or shaft and seated within a recess of an end piece 100 of the flapper brush 60. FIG. 14B illustrates an embodiment of a flapper end piece, which may be similar to the shaft housing 70 or 70' shown in FIGS. 5 and 6 in accordance with the present teachings, similar to or the same as the embodiment shown in cross section and discussed with respect to FIGS. 5 and 6, including a bearing 16 that is integrally molded or formed with a shroud, such as shroud 78 or 78' in FIGS. 5 and 6, for example. FIG. 14C provides a comparison between an existing bearing end (top) of a flapper brush and the embodiment of FIG. 11B (bottom), which shows a smaller size of a secondary guard (such as secondary guard 74, shown in FIG. 5, for example), but a larger reservoir (for example, recessed area 73 shown in FIG. 5 or reservoir 40" shown in FIG. 6) between the main guard 72 and the secondary guard 74 to hold hair and similar matter that has entered an interior of the shroud.

As stated above, certain embodiments of the present teachings contemplate a shroud provided for a drive end of the flapper brush, or an increased reservoir size for the flapper brush drive end.

Figure 15:
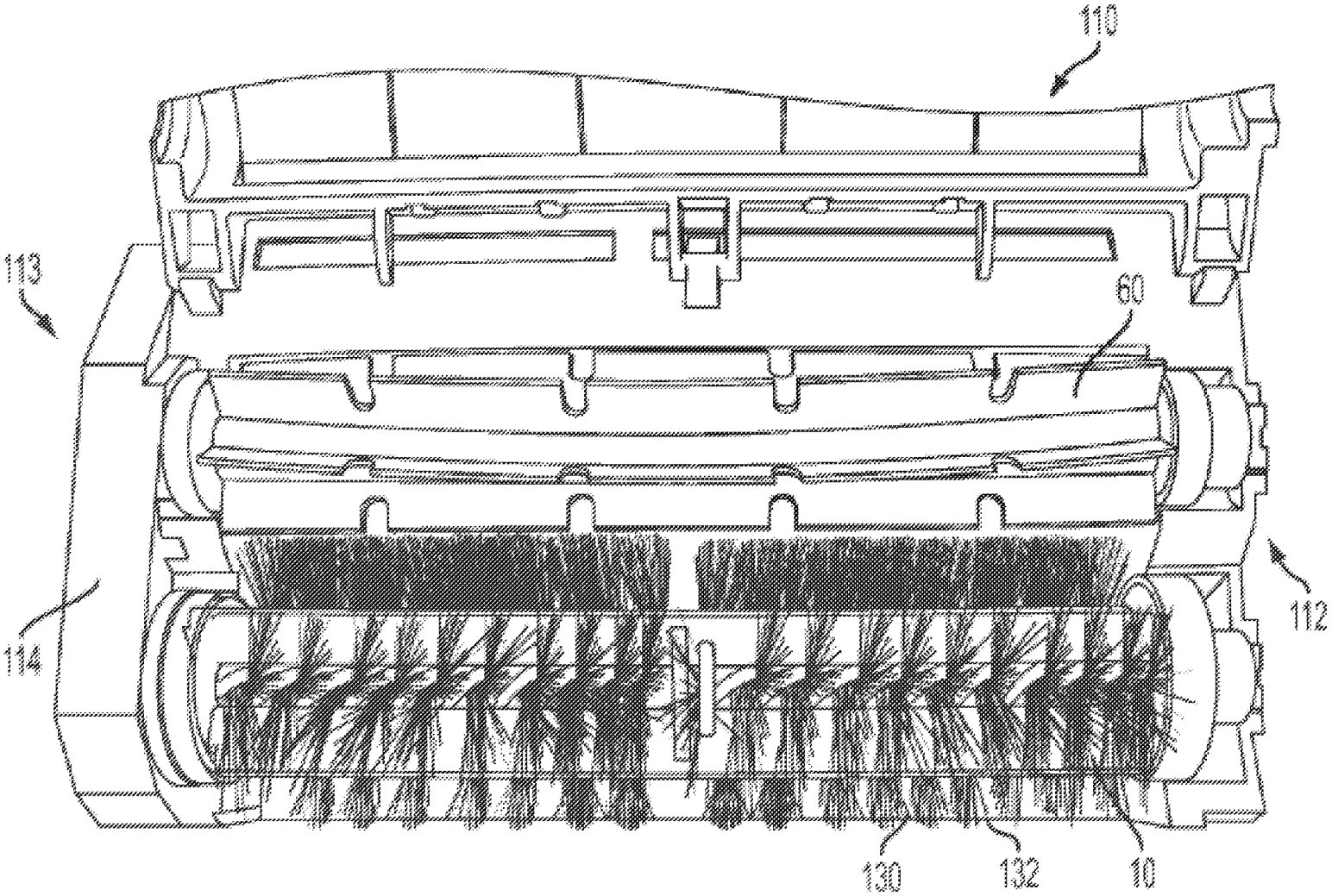
FIG. 15 is a front view of a cleaning head compartment.

FIG. 15 illustrates a cleaning head subsystem for a robotic vacuum with brushes having ends configured in accordance with various embodiments of the present teachings. FIG. 15 illustrates the cleaning head compartment 110 having a bearing end 112 and a drive end 113, with main 10 and flapper 60 brushes mounted therein, the bearing end 112 of the main 10 and flapper 60 brushes being shrouded in accordance with the present teachings and the drive end 113 of the brushes being provided with a shrouded gearbox housing 114 at the gearbox 81. It will be understood by one of ordinary skill in the art that any of the embodiments described above may be installed within the cleaning head compartment 110. The shrouded gearbox housing 114 including the gearbox 81 may be divorced from the cleaning head compartment 110 so that, for example, the shrouded gearbox may be able to be manufactured separately from the cleaning head compartment 110.

In addition, as shown in FIG. 15, the main brush 10 may include two sets of bristles 130, 132. A first set of bristles 130 may have a relatively larger diameter than a second set of bristles 132. More of the second set of bristles 132 may be provided, which provides more floor contact due to the increased number of bristles. Two bristle diameter types are provided to be able to pick up different types of materials. In an embodiment, approximately 70% of the second set of bristles may be provided, while approximately 30% of the first set of bristles may be provided. It will be understood to one of ordinary skill, however, that the percentages may be variable. In addition, the first set of bristles 130 may have a diameter of 0.2 mm, while the second set of bristles may have a diameter of 0.1 mm.

FIG. 16 is a front perspective view of an exemplary embodiment of a shrouded gearbox housing 114 for use on a drive end of a robotic vacuum cleaning head compartment in accordance with certain embodiments of the present teachings. Using the illustrated embodiment, the shrouding can be located on the gearbox rather than on the drive end of the flapper and brush engaged therewith to be driven. A partial cross section of the shrouded gearbox housing 114 can be seen in FIG. 7A and include a shroud 115 located around the main brush drive recess 116 and a shroud 117 located around the flapper brush drive recess 118. As seen in FIG. 16, for example, a plurality of reception recesses 128 may be disposed within the gear so that the gear is able to retain the retention device 80.

FIG. 17 is a top view of gears for the main brush and the flapper brush in accordance with the present teachings. FIG. 17 shows an exemplary embodiment of a gear 120 for the main brush, which may be similar to gear 82 of FIG. 8A, and an exemplary embodiment of a gear 124 for the flapper brush. The main brush gear 120 includes a gear recess 122, and the flapper brush gear 124 includes a gear recess 126. The main brush gear recess 122 is relatively larger than the flapper brush gear recess 126 as the drive protrusion for the main brush includes the retention device, which increases the size of the drive protrusion to be received into the gear recess 122. While it is shown and described to include the retention device 80 as part of the main brush 10 and received in the main brush gear 122, it will be understood by those of ordinary skill in the art that the flapper brush may additionally or alternatively include the retention device 80 and the recess 126 of the flapper brush gear 124 may have an increased size in this case due to the increased size of the drive protrusion including the retention device 80. As discussed above, a plurality of reception recesses 128 may be provided within the gear recess 122 in order to be able to retain the interlocking members 84 of the retention device 80.

Figure 18:
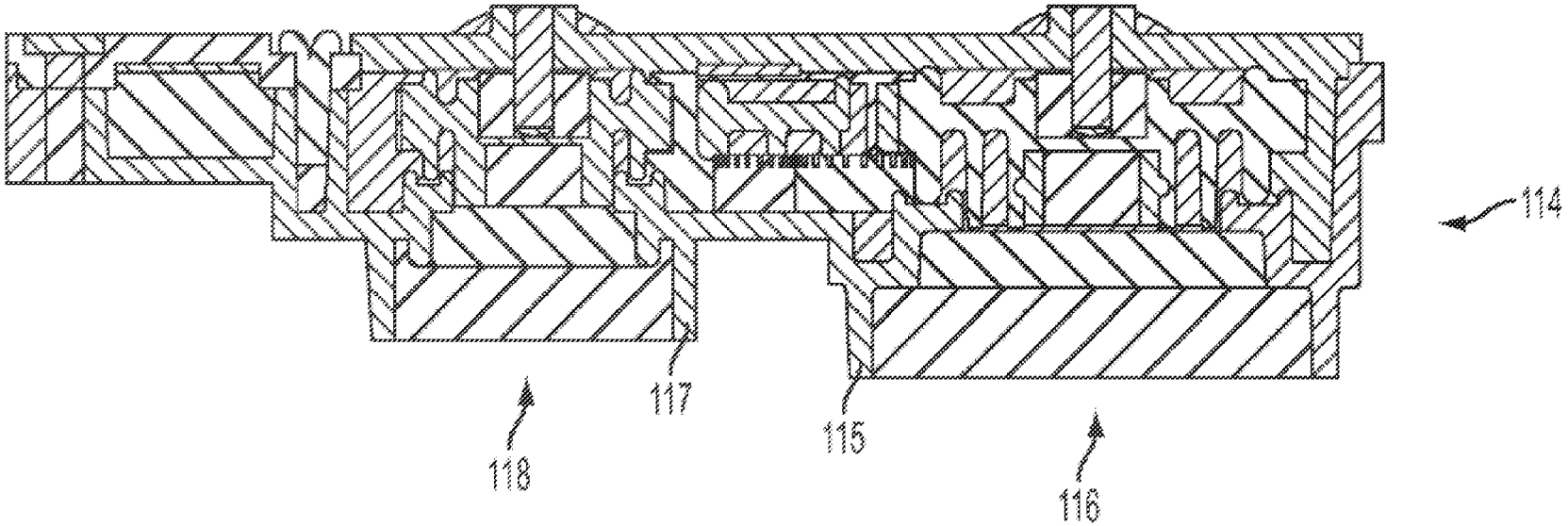
FIG. 18 is a cross-sectional view of the shrouded drive end of the cleaning head compartment.

FIG. 18 is a cross-sectional view of the divorced shrouded gearbox shown in FIG. 7A, for example. The shrouded gearbox 114 includes the shroud 115 located around the main brush drive recess 116 and the shroud 117 located around the flapper brush drive recess 118.

Figure 19A:
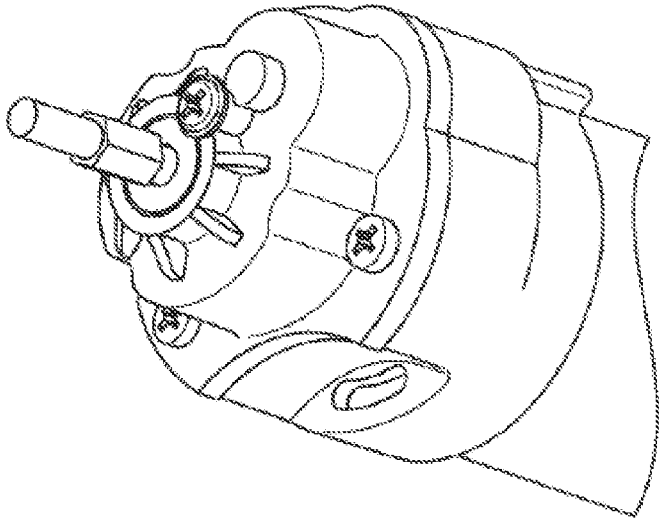
FIG. 19A is a perspective view of an existing motor.
Figure 19B:
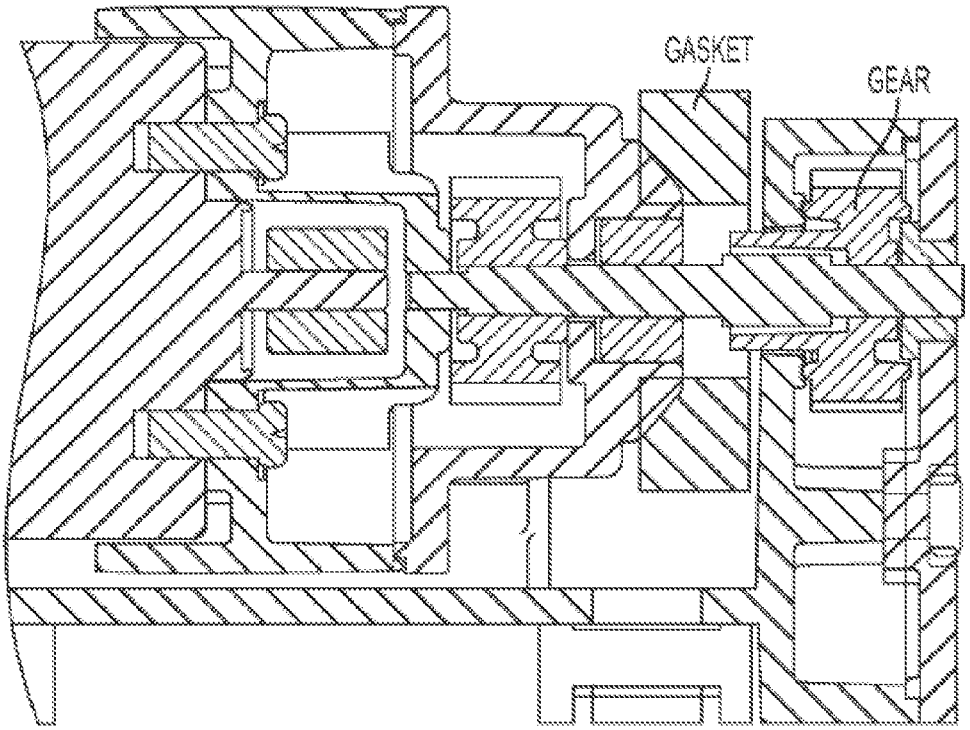
FIG. 19B is a cross-sectional view of the existing motor.
Figure 20A:
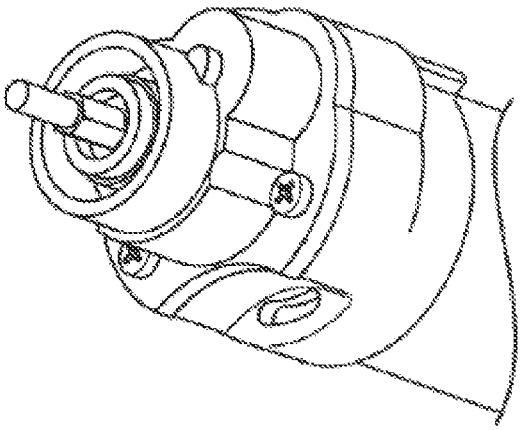
FIG. 20A is a perspective view of a shrouded motor in accordance with the present teachings.
Figure 20B:
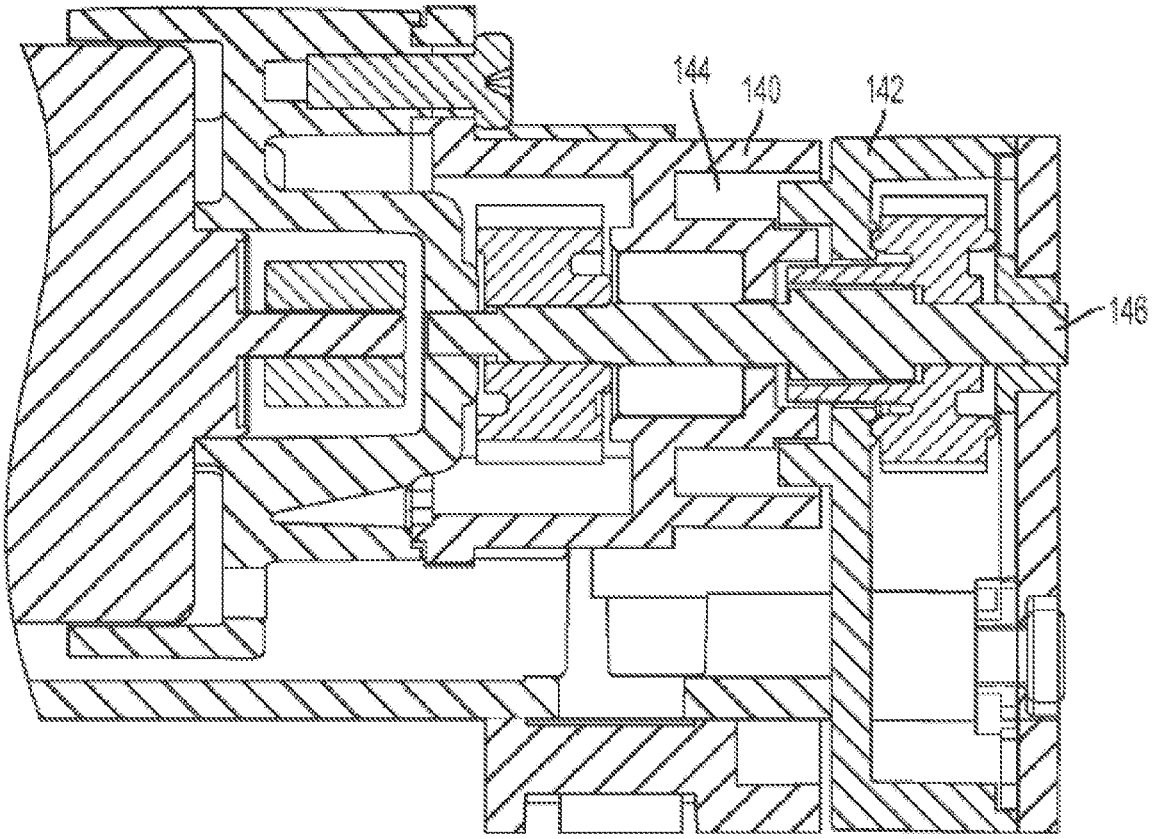
FIG. 20B is a cross-sectional view of the shrouded motor of FIG. 20A.
Figure 21:
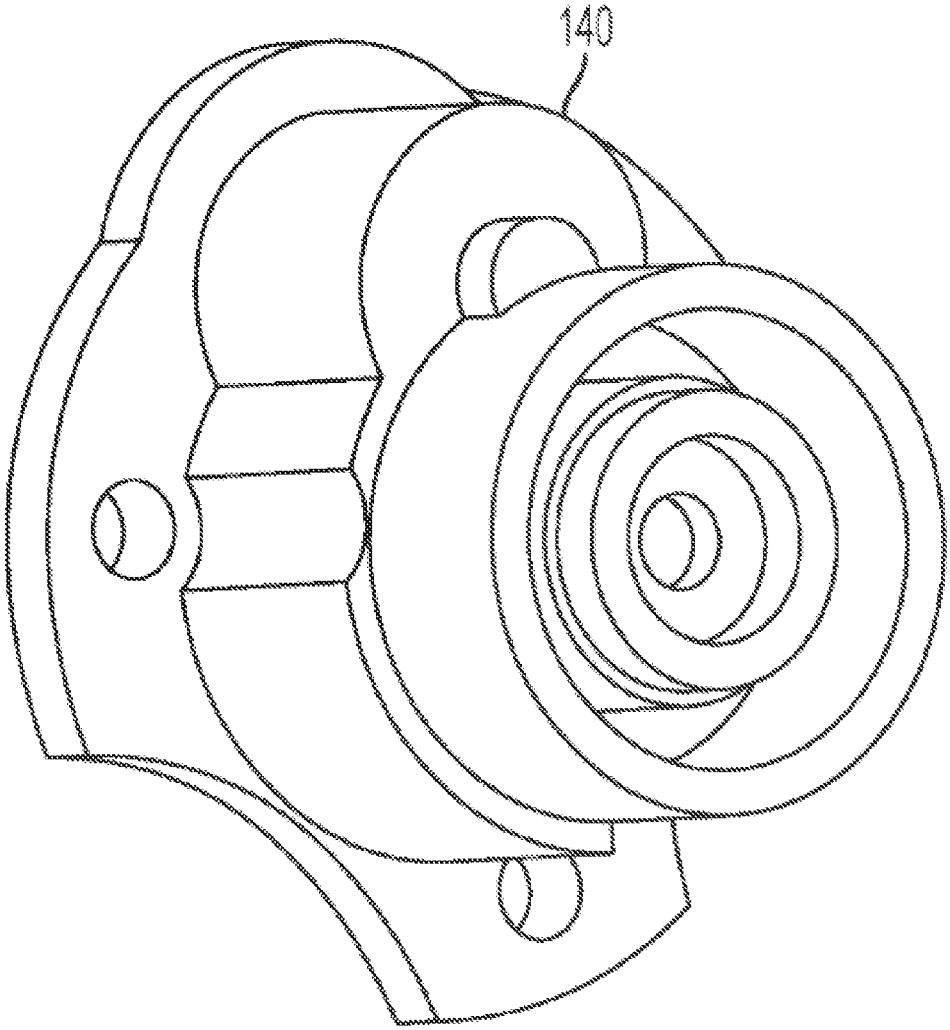
FIG. 21 is an exterior perspective view of the shroud for the motor shown in FIGS. 20A and 20B.

FIG. 19A is a perspective view of an existing motor, and FIG. 19B is a cross-sectional view of the existing motor. FIG. 20A is a perspective view of a shrouded motor in accordance with the present teachings, and FIG. 20B is a cross-sectional view of the shrouded motor of FIG. 20A in accordance with the present teachings. The motor shown in FIG. 20B includes a shroud 140 that engages with a gearbox housing 142, with a shaft 146 extending therethrough. A recessed collection area 144 is provided within interior of the shroud 140 and is able to additionally collect hair and other matter before the hair and other matter are able to migrate to the motor. FIG. 21 is an exterior perspective view of the shroud 140 for the motor shown in FIGS. 20A and 20B.

Other embodiments of the present teachings will be apparent to those skilled in the art from consideration of the specification and practice of the teachings disclosed herein. For example, the present teachings apply to a robotic vacuum having a single brush or a single brush having a structure in accordance with the present teachings, and to robotic vacuums having more than two brushes. In addition, the present teachings apply generally to rotating cleaning elements for a robotic vacuum that are configured to lift debris from the floor. The rotating cleaning elements can include a brush, a flapper, or a similar device. It is intended that the specification and examples be considered as exemplary only, with a true scope and spirit of the present teachings being indicated by the following claims.

What is claimed is:

1. A cleaning element insertable into a vacuum compartment, the cleaning element comprising:
- a brush assembly defining a central axis and including a bearing end portion comprising:
  - a shaft rotatable about the central axis;
  - a flange connected to the shaft and extending radially outward of the shaft, the shaft extending axially beyond the flange, and the flange rotatable with the shaft; and
  - a guard connected to the shaft and extending radially outward from the shaft, the guard rotatable with the shaft, the guard separate and distinct from the flange;
- a bearing connected to at least a portion of the shaft to allow the shaft to rotate within the vacuum compartment; and
- a shroud supporting the bearing and located with respect to the flange to form a first radial labyrinth passage between the flange and the shroud and to form a second radial labyrinth passage between the guard and the shroud, the guard located between the flange and the shroud.

2. The cleaning element of claim 1, wherein the first labyrinth passage is formed between an outer diameter of the flange and a first wall of the shroud.

3. The cleaning element of claim 2, wherein the first wall is parallel to the shaft.

4. The cleaning element of claim 3, the shroud comprising:
- a second wall that extends perpendicular to the first wall; and
- a third wall that extends from the second wall parallel to the first wall.

5. The cleaning element of claim 4, wherein the second labyrinth passage is formed between the guard and the third wall of the shroud.

6. The cleaning element of claim 3, the shroud comprising:
- a fourth wall that extends from the third wall parallel to the second wall.

7. The cleaning element of claim 1, wherein the brush includes a brush cage, the shaft secured to the brush cage.

8. The cleaning element of claim 7, wherein the flange is integrally formed with or mounted to the brush cage.

9. The cleaning element of claim 1, wherein the bearing is releasably securable to the shroud.

10. A cleaning element insertable into a vacuum compartment, the cleaning element comprising:
- a brush assembly defining a central axis comprising:
  - a shaft rotatable about the central axis;
  - a flange extending radially outward of the shaft, the shaft extending axially beyond the flange; and
  - a guard connected to the shaft and extending radially outward from the shaft, the guard rotatable with the shaft, the guard separate and distinct from the flange;
- a bearing connected to at least a portion of the shaft to allow the shaft to rotate within the vacuum compartment; and
- a shroud supporting the bearing and located with respect to the flange to form a labyrinth passage between the flange and the shroud having a U-shape facing radially outward, the guard located between the shroud and the flange.

11. The cleaning element of claim 10, wherein the labyrinth passage is formed between an outer portion of the flange and a first wall of the shroud.

12. The cleaning element of claim 11, wherein the first wall is parallel to the shaft.

13. The cleaning element of claim 12, the shroud comprising:
- a second wall that extends perpendicular to the first wall; and
- a third wall that extends from the second wall parallel to the first wall.

14. The cleaning element of claim 13, the shroud comprising:
- a fourth wall parallel to the second wall.

15. The cleaning element of claim 13, wherein the flange extends radially outward of the guard.

16. The cleaning element of claim 15, wherein the guard extends radially outward of the bearing.

17. A cleaning element insertable into a vacuum compartment, the cleaning element comprising:
- a brush assembly defining a central axis and including a bearing end portion comprising:
  - a shaft rotatable about the central axis;
  - a flange connected to the shaft and extending outward of the shaft perpendicular to the central axis, the shaft extending axially beyond the flange, and the flange rotatable with the shaft; and
- a guard connected to the shaft and extending outward from the shaft; perpendicular to the central axis, the guard rotatable with the shaft;
- a bearing connected to at least a portion of the shaft to allow the shaft to rotate within the vacuum compartment; and
- a shroud, the guard located between the flange and the shroud, the shroud supporting the bearing, and the shroud including:
  - a first wall parallel to the central axis and located with respect to the flange to form a first labyrinth passage between the flange and the shroud; and
  - a second wall parallel to the central axis and connected to the first wall and located radially inward of the first wall, the second wall located with respect to the guard to form a second labyrinth passage between the guard and the shroud.

18. The cleaning element of claim 17, wherein the brush includes a brush cage secured to the shaft.

19. The cleaning element of claim 18, wherein the flange is integrally formed with or mounted to the brush cage.

* * * * *